US011458346B1

(12) United States Patent
Gulick et al.

(10) Patent No.: US 11,458,346 B1
(45) Date of Patent: Oct. 4, 2022

(54) PORTABLE AND VARIABLE EXERCISE DEVICE

(71) Applicant: Blix Strength LLC, Spring City, PA (US)

(72) Inventors: Dawn T. Gulick, Spring City, PA (US); Zachary John Pelli, Philadelphia, PA (US); Thomas D. Kauffman, Glenside, PA (US)

(73) Assignee: Strength Technology LLC, Spring City, PA (US)

( * ) Notice: Subject to any disclaimer, the term of this patent is extended or adjusted under 35 U.S.C. 154(b) by 0 days.

(21) Appl. No.: 17/568,864

(22) Filed: Jan. 5, 2022

(51) Int. Cl.

| | |
|---|---|
| ***A63B 21/02*** | (2006.01) |
| ***A63B 21/00*** | (2006.01) |
| ***A63B 21/16*** | (2006.01) |
| ***A63B 23/035*** | (2006.01) |

(52) U.S. Cl.
CPC ..... *A63B 21/025* (2013.01); *A63B 21/00065* (2013.01); *A63B 21/153* (2013.01); *A63B 21/1645* (2013.01); *A63B 21/1663* (2013.01); *A63B 21/1672* (2015.10); *A63B 23/03508* (2013.01); *A63B 23/03541* (2013.01); *A63B 23/0355* (2013.01)

(58) Field of Classification Search
CPC ..... A63B 21/00058; A63B 21/00061; A63B 21/00065; A63B 21/00069; A63B 21/00076; A63B 21/022; A63B 21/023; A63B 21/025; A63B 21/026; A63B 21/04; A63B 21/0442; A63B 21/08; A63B 21/15; A63B 21/151; A63B 21/152; A63B 21/153; A63B 21/154; A63B 21/155; A63B 21/22; A63B 21/4045; A63B 21/4049; A63B 23/035; A63B 23/03508; A63B 23/12; A63B 23/1209; A63B 23/1254; A63B 23/1263; A63B 23/127; A63B 22/0076; A63B 22/0087; A63B 22/0089; A63B 2022/0079; A63B 2022/0082; A63B 2022/0084
See application file for complete search history.

(56) References Cited

U.S. PATENT DOCUMENTS

| | | | | |
|---|---|---|---|---|
| RE1,853 | E * | 1/1865 | Focht | 254/415 |
| 3,858,873 | A | 1/1975 | Jones | |
| 4,208,049 | A | 6/1980 | Wilson | |
| 4,231,568 | A | 11/1980 | Riley et al. | |
| 4,725,057 | A | 2/1988 | Shifferaw | |
| 4,730,829 | A | 3/1988 | Carlson | |

(Continued)

FOREIGN PATENT DOCUMENTS

| | | |
|---|---|---|
| EP | 0155629 B1 | 7/1988 |
| EP | 0438758 A1 | 7/1991 |
| WO | WO2017037337 | 3/2017 |

*Primary Examiner* — Nyca T Nguyen
*Assistant Examiner* — Zachary T Moore
(74) *Attorney, Agent, or Firm* — Schott, P.C.

(57) ABSTRACT

The apparatus provides an exercise device that is portable, versatile, and enables the user to match the resistance of the device with the normal physiologic length-tension relationship of skeletal muscle. The device adds resistance in the form of cartridges that are stackable to summate resistance and can connect to a variety of attachments for use with arms, legs, or trunk, i.e., handle, bar, loop, etc. Given the device's portability, it can be used freestyle or mounted to various surfaces.

14 Claims, 21 Drawing Sheets

(56) References Cited

U.S. PATENT DOCUMENTS 4,902,007 A 2/1990 Farrari
4,930,770 A 6/1990 Baker
5,242,351 A 9/1993 Berg et al.
5,312,309 A * 5/1994 Fox ..... A63B 21/0004 482/45
5,356,360 A 10/1994 Johns
5,505,681 A * 4/1996 Bruggemann ..... A63B 21/153 482/904
5,554,085 A 9/1996 Dalebout
5,733,231 A 3/1998 Corn et al.
5,762,587 A 6/1998 Dalebout et al.
5,993,356 A 11/1999 Houston et al.
6,149,094 A * 11/2000 Martin ..... F03G 1/06 242/375.3
6,527,683 B2 3/2003 Tolles
6,652,426 B2 11/2003 Carter et al.
6,685,602 B2 * 2/2004 Colosky, Jr. ..... A63B 21/025 482/904
6,770,014 B2 8/2004 Amore
7,282,016 B2 10/2007 Simonson
7,524,272 B2 * 4/2009 Bruck ..... A63B 22/02 482/54
7,625,321 B2 12/2009 Simonson et al.
7,785,232 B2 8/2010 Cole et al.
7,878,955 B1 * 2/2011 Ehrlich ..... A63B 21/025 482/127
8,061,483 B2 * 11/2011 Moriarty ..... A63B 21/0088 188/270
8,162,802 B2 4/2012 Berg
9,254,409 B2 2/2016 Dalebout et al.
9,320,936 B1 4/2016 Rea et al.
9,339,692 B2 5/2016 Hashish
9,403,047 B2 8/2016 Olson et al.
9,616,276 B2 4/2017 Dalebout et al.
9,700,751 B2 * 7/2017 Verdi ..... A63B 21/4017
9,757,605 B2 9/2017 Olson et al.
9,884,220 B2 2/2018 Smith et al.
10,556,143 B2 * 2/2020 Sherin ..... A63B 21/025
2002/0025891 A1 * 2/2002 Colosky, Jr. ..... A63B 21/0455 482/127
2011/0237407 A1 * 9/2011 Kaleal ..... A63B 23/03541 482/114
2018/0214731 A1 * 8/2018 Sherin ..... A63B 21/025
2020/0069993 A1 * 3/2020 Kumelis ..... A63B 21/008
2021/0121315 A1 * 4/2021 Zahynacz ..... A61B 90/57
2022/0168606 A1 * 6/2022 Herring ..... A63B 21/00065

* cited by examiner

PORTABLE AND VARIABLE EXERCISE DEVICE

BACKGROUND

Weightlifting is a popular activity that uses equipment to challenge the muscles to an optimal level. Yet weightlifters are not the only individuals who benefit from strength training. Sufficient strength is required to perform daily activities and restoration of strength is required after an injury or surgery. Likewise, resistance training is beneficial over all aspects of the lifespan to prevent muscle atrophy during the aging process.

There are many exercise devices that help with strength training. They include single/stand-alone joint-specific devices to large, multi-use devices to dumb bells. Some use a fixed amount of resistance through the range of motion (ROM). Others vary the resistance through the ROM. However, no device to date combines variable resistance with portability and versatility.

In addition, the manner in which resistance is applied is important. Skeletal muscle does not overcome resistance in a linear format. In order words, as a muscle contracts, it does not produce more force as it moves through the complete ROM. The force production of a muscle is influenced by the length-tension relationship of the muscle fibers. The muscle fibers include sarcomeres that have actin and myosin filaments. The overlap of these filaments determines their force-generating capacity. The result of this anatomy is a force curve of the muscle that starts low, moves higher for the middle range, then drops back low again as the joint progresses to the end of the ROM. FIG. 1 explains this relationship at various points of muscle fiber (sarcomere) overlap. In FIG. 1, the top three representations show a person using the biceps muscle to move the arm from a straight elbow position (left) to a mid-range elbow position (middle) to a bent elbow position (right).

The middle graph in FIG. 1 shows elbow position vs percentage of force generation during the range of motion. The optimal range of motion for maximal force generation is in the middle portion of the movement.

The muscle fiber/sarcomere overlap in the bottom portion of FIG. 1 shows how this relationship directly corresponds with the contraction of a muscle. In other words, the force generating capacity of a muscle is limited at each end of the available range and greatest in the middle of the range. This is why people inherently pick up heavy objects with their joints positioned in the middle of their available range of motion (ROM). This is the position at which the sarcomeres are at optional orientation (overlap).

An example illustrates the point. When a person lifts a 5-pound dumbbell weight, it is 5-pounds of resistance through the entire ROM. Yet, that 5-pounds is harder to lift at the beginning and end of the ROM because it represents a greater percentage of the muscle capacity in that position. Similarly, the same 5-pound weight is easier to move in the middle of the ROM because there is a lower percentage of the muscle capacity.

Shifting this example to exercise equipment, this is true of 5-pounds on a wall pulley or 5-pounds on a weight stack. There is still 5-pounds of resistance applied to the muscle as the joint moves through the entire ROM. This does not bode well for the development of strength to produce fluid motion. A person can never lift more than the limitations imposed by the 2-ends of the motion. Therefore, the mid-range of the muscle is never truly challenged and maximal muscle strengthening is not achieved. Additionally, a person may attempt to compensate for this by increasing the weight to challenge the mid-range of the muscle. This either limits the range of motion through which a person can exercise or puts excess stress on the weaker portion of the ROM that could result in increased risk of injury.

From all the anatomical background above, conventional strength training methods do not stress a target muscle to match the force curve in FIG. 1 and instead over-stress the two ends of the available motion while under-stressing the middle of the available motion.

SUMMARY OF THE EMBODIMENTS

The device herein addresses the above problems. The device includes a main interface mechanism that includes a pulley, cable leads, a force modulating cylinder, and a constant force spring. Different resistance cartridges may be added to the main interface mechanism to add resistance for a given exercise while maintaining the same length-tension relationship. The interface mechanism alone or the interface mechanism with cartridges work together to alter the resistance/tension through the ROM of a joint to match the length-tension relationship of the muscle.

An adjustable, portable exercise device includes an interface mechanism that includes coiled cables around a varying diameter helical cam, some spools, a constant force spring, and handles (of various interchangeable types); central shaft that is used to add resistance through the addition of supplementary resistance cartridges, and 1 mechanism to fixate 1-end of the main body on a fixed location, whether it be a door-frame, a bar or beam on another piece of exercise equipment, a solid fixture on a piece of household furniture, or any other stationary unit. Other attachments also may be swapped out, including a foot plate or second handle for free use without attachment to a stationary fixture.

The exercise device may provide variable resistance to mimic the length-tension curve of normal skeletal muscle. The exercise device could provide resistance for both concentric (positive) and eccentric (negative) contractions, just concentric, and/or just eccentric contractions. The baseline device may be used for any muscle that has a large range of motion (i.e., shoulders, elbows, hips, knees, back). Slight modifications to the device allow the stroke to be refitted to muscles with more limited range of motion, such as the ankle or wrist.

DETAILED DESCRIPTION OF THE EMBODIMENTS

Figure 2:
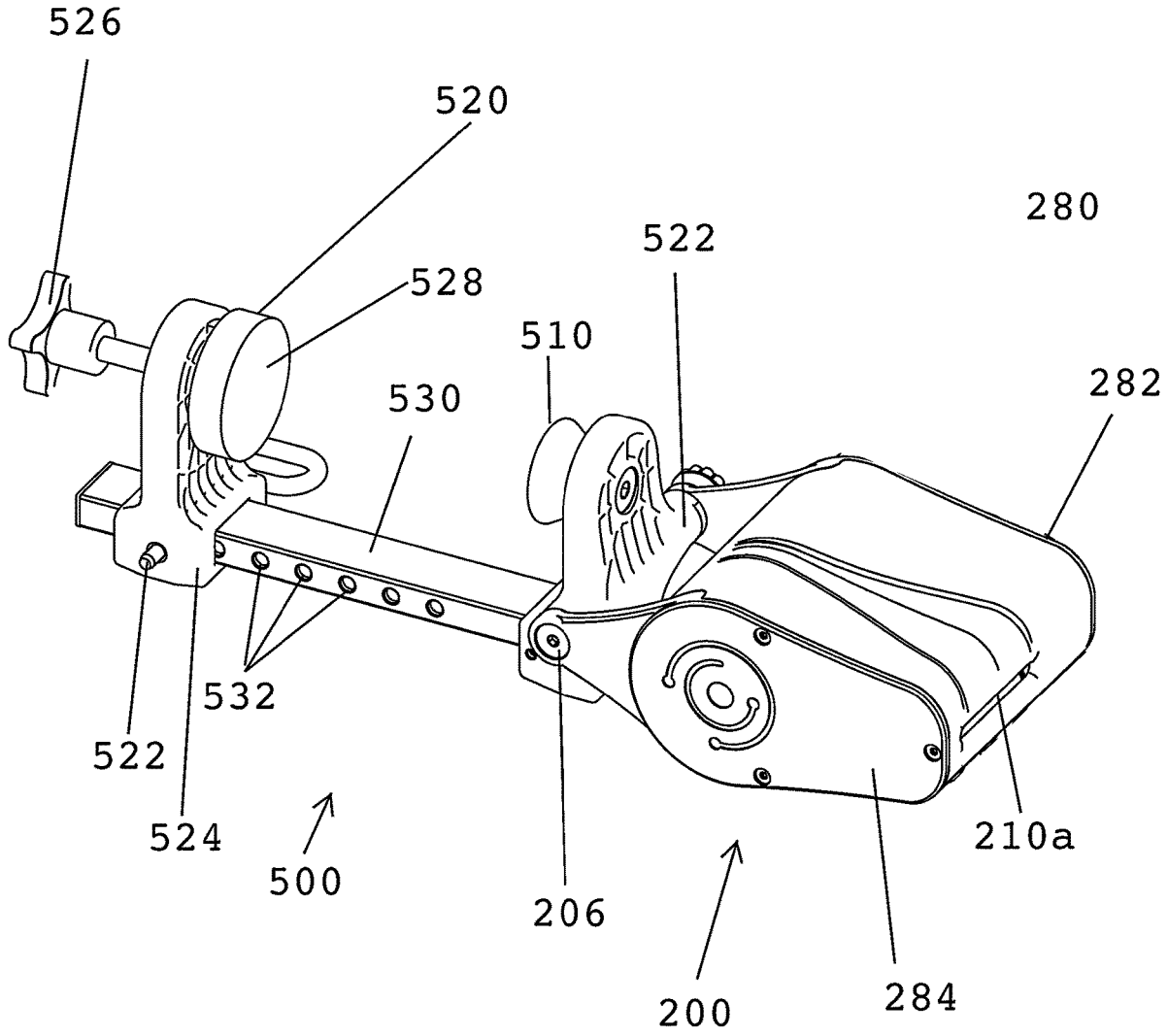
FIG. 2 shows a perspective view of the interface mechanism and clamp.
Figure 3:
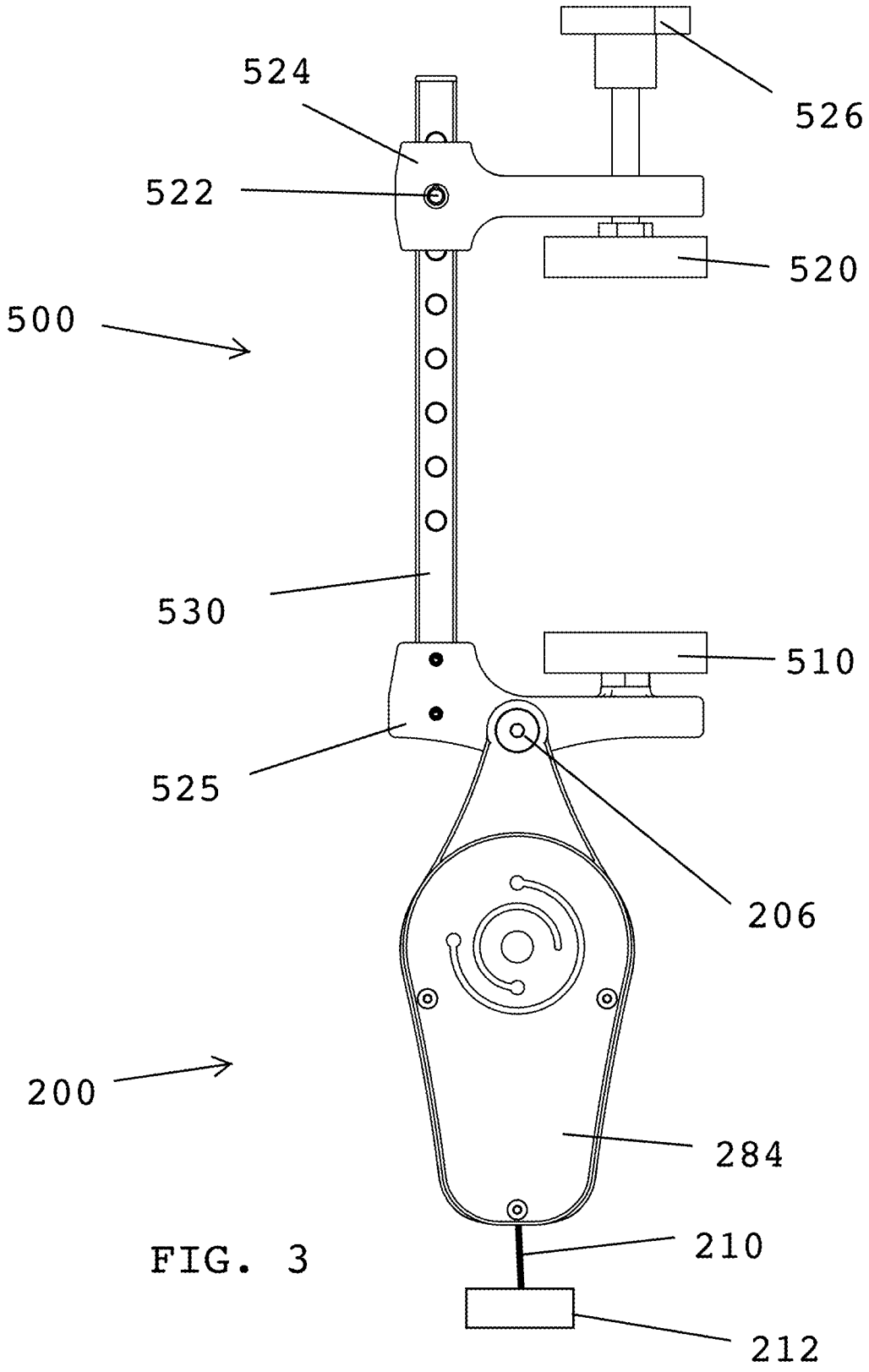
FIG. 3 shows a side elevation of the interface mechanism and clamp.

FIGS. 2 and 3 show different views of an interface mechanism 200 for use as a therapy and exercise device. As shown and by way of an overview description, a user mounts the interface mechanism 200 using a clamping fixture 500, though other mounting mechanisms are possible and the handle 206 may be attached to any stable surface. As shown, the clamping fixture 500 is engaged with the mounting handle 206 with the handle 206 extending through the mounting fixture 500. The mounting fixture 500 may be rotatable with respect to the interface mechanism to give a user a variety of angles to work with. The mounting fixture 500 may be lockable or immovable with respect to the interface mechanism 200 to give the user a stable base.

The clamping fixture includes a first mounting pad 510 attached to a guide 524 attached to the mounting handle 206 and a second mounting pad 520 engaged in a sliding engagement with a track 530, between which mounting pads may be placed for a suitable anchor point to secure the interface mechanism 200 during use. The second mounting pad may include a pin 522 that can be removed (or other removeable engagement) to allow the second mounting pad 520 to be moved closer and further from the first mounting pad 510 along the length of the track 530. The pin 522 may extend through guides 524 on the second mounting pad 520 and holes 532 in the track 530. The second (or first) mounting pad 520 may include a fine adjustment screw 526 that controls movement of a mounting pad 528 for fine adjustments. Fine adjustments could also be controlled at the first mounting pad 510 in a similar way. Other mounting arrangement are possible and not shown.

Once clamped in place, the interface mechanism 200 functions as shown in FIGS. 4A-4D that show partial cutaway views of the interface mechanism 200 as it moves between resting (FIG. 4A), starting (FIG. 4B), middle (FIG. 4C), and end (FIG. 4D) positions.

Figure 4A:
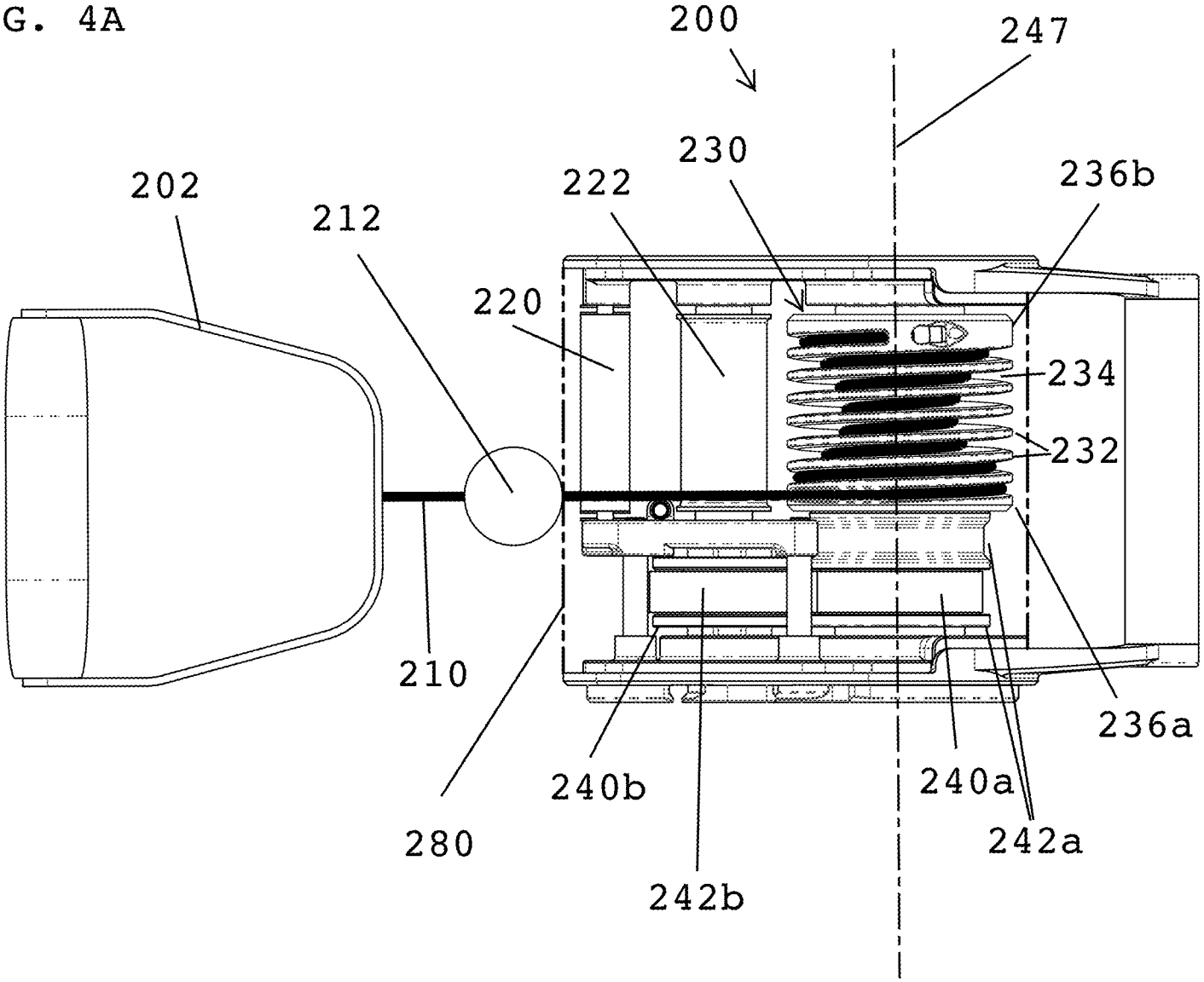
FIG. 4A shows a partial cutaway view of the resting position of the interface mechanism.

FIG. 4A shows the resting position of the interface mechanism 200. The interface mechanism 200 includes a cable 210 that extends therefrom and engages an exchangeable exercise attachment 202, shown as a grip in FIGS. 4A-4D. The interface mechanism 200 further includes a mounting handle 206 that can be removed and reattached for engagement with a stable anchor like a basement support post. The mounting handle 206 may further be engaged to an attachment mechanism 500 embodied like an adjustable clamp as shown in FIGS. 2 and 3. End plates 282, 284 provide bases and openings for mounting axial pins for a cable pulley, which is shown herein as a cable pulley and more particularly in a preferred embodiment a force modulating pulley 230, spring pulleys 242*a*, 242*b*, idler pulleys 222, guide pulleys 220, and other structural supports. The cartridge end plate 284 also provides the interface for cartridges, to be described later.

In the resting position, the interface mechanism 200 has its cable 210 extending from outside the housing 280 into the housing 280 through a slot 210*a* therein between guide pulleys 220, over an idler pulley 222 wound to a maximum extent around a force modulating pulley 230. In this rest position, a stop 212 rest against the housing 280 and prevents further draw of the cable 210 into the interface mechanism 200. It should be appreciated that the slot 210*a* allows for movement of the cable 210 from side to side during use.

The cable 210 in the resting position is kept taught around the force modulating pulley 230 by preloading a constant force spring 240 (a flat wound spring as shown) with a preload section 240*a* mounted on the preload pulley 242*a* and a storage section 240*b* mounted on a storage pulley 242*b*. It should be appreciated that the preload pulley 242*a* (attached to and rotating with rotation of the force modulating pulley 230 around a common axis 247 via pulley pins 243 extending into mating receiving holes in the force modulating pulley 230) and storage pulley 242*b* (rotating about a parallel axis 249) rotate in opposite directions to one another and lengths of the constant force spring 240 pass from one pulley to another during operation of the interface mechanism 200 as will continue to be described. The constant force spring 240, as the name implies, provides a constant resistant force to rotation of the force modulating pulley 230 when drawing of the cable 210 from the interface mechanism 200.

The force modulating pulley 230 includes a helical thread 232 along its length between which the cable 210 winds. Between the helical thread 232, the cable 210 rests against cable receiving valleys 234 that have an hourglass profile when viewed from the view of FIGS. 4A-4D. This hourglass profile, with a wider width at the ends 236*a*, 236*b* of the force modulating pulley 230 and a narrow width at a middle thereof allows the interface mechanism 200 to provide a low-to-high-to-low force relationship to the muscle being worked. The cable 210 attaches to the force modulating pulley 230 at a mounting end 236*b* thereof and may be attached thereto by mounting a stop to the cable 210's end or other mounting as may be effective to prevent the cable 210 from fully disengaging from the force modulating pulley 230.

Figure 4B:
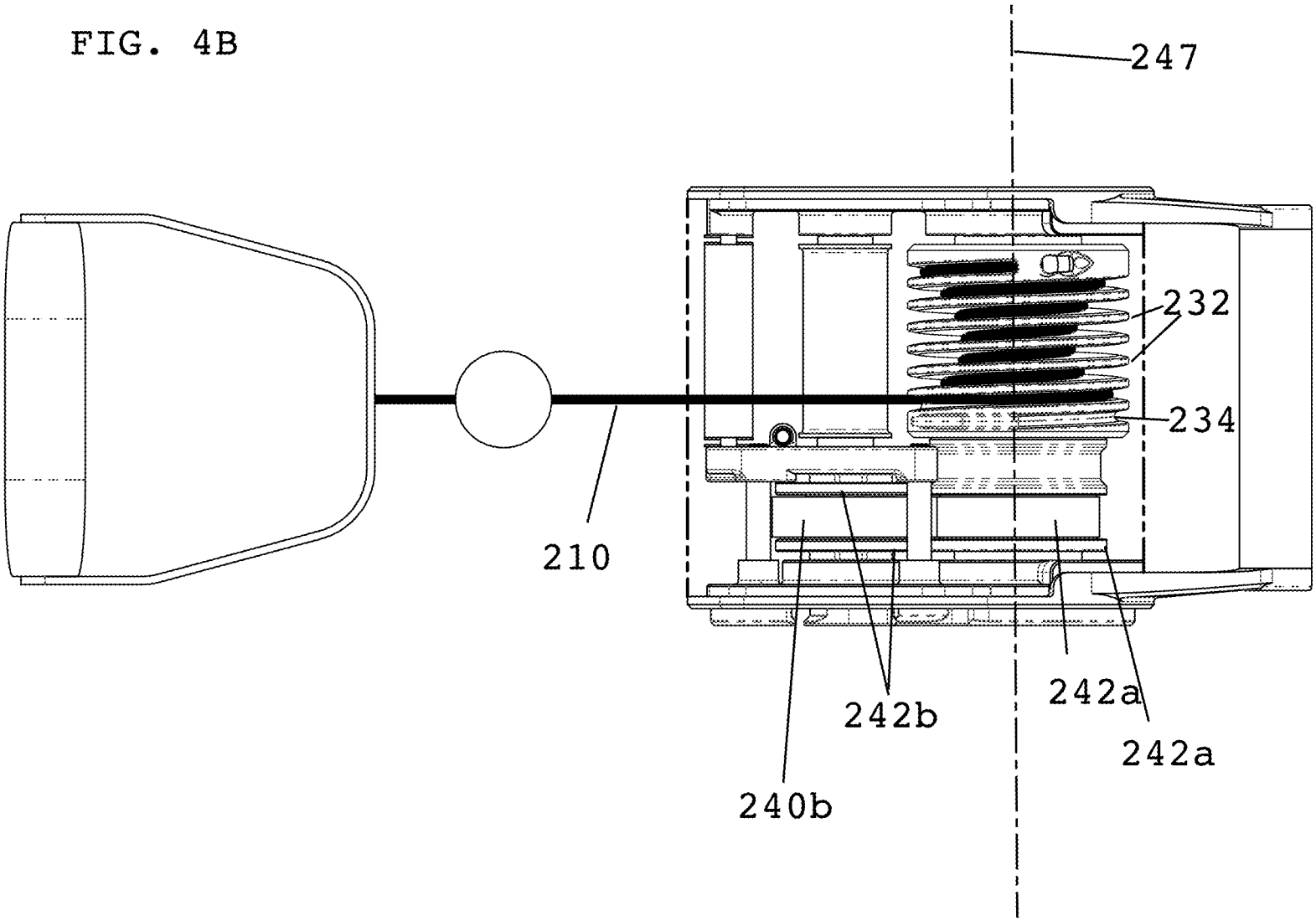
FIG. 4B shows a partial cutaway view of the stroke start of the interface mechanism.

FIG. 4B shows the interface mechanism 200 in a start position where the cable 210 has begun to be drawn from the housing 280 at a point where the cable receiving valleys 234 are at their nearly maximum diameter. The cable 210 remains engaged to the force modulating pulley 230 but no longer engages the starting end 236*b* of the force modulating pulley 230. At the same time, the force modulating pulley 230's counterclockwise rotation rotates the preload pulley 242*a* also in a counterclockwise direction, which winds more length of the constant force spring 240 from the preload section 240*a* to the storage section 240*b*, it being understood that the preload pulley 242*a* rotates in the opposite direction to the storage pulley 242*b*.

Figure 4C:
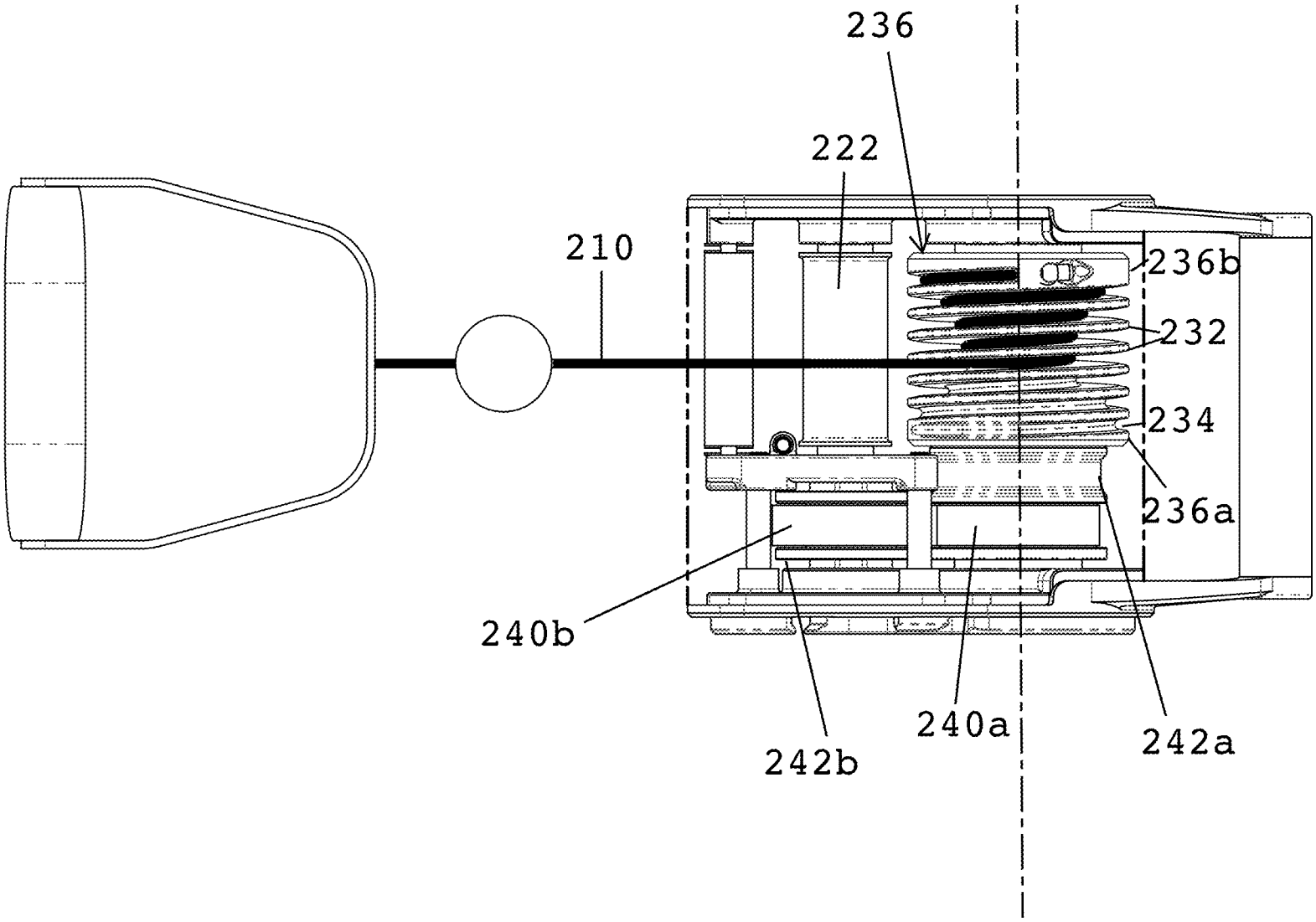
FIG. 4C shows a partial cutaway view of the stroke middle of the interface mechanism.

FIG. 4C shows the interface mechanism 200 at a point in the middle of its longest pull possibility, meaning that the cable 210 has been unwound on the force modulating pulley 230 to a point where the cable receiving valleys 234 have a minimal diameter. Being thus at a minimal diameter, the torque lever arm is at its smallest, thus the force from the user required to pull the cable is at its highest. the force modulating pulley 230 has increased the force required to draw the cable 210, and thus ideally at a mid-point of a muscle range when the muscle is at its maximal strength potential, it is doing more work. Like the starting view shown in FIG. 4B, this view shows that the force modulating pulley 230's counterclockwise rotation rotates the preload pulley 242*a* also in a counterclockwise direction, which winds more length of the constant force spring 240 from the preload section 240*a* to the storage section 240*b*.

Figure 4D:
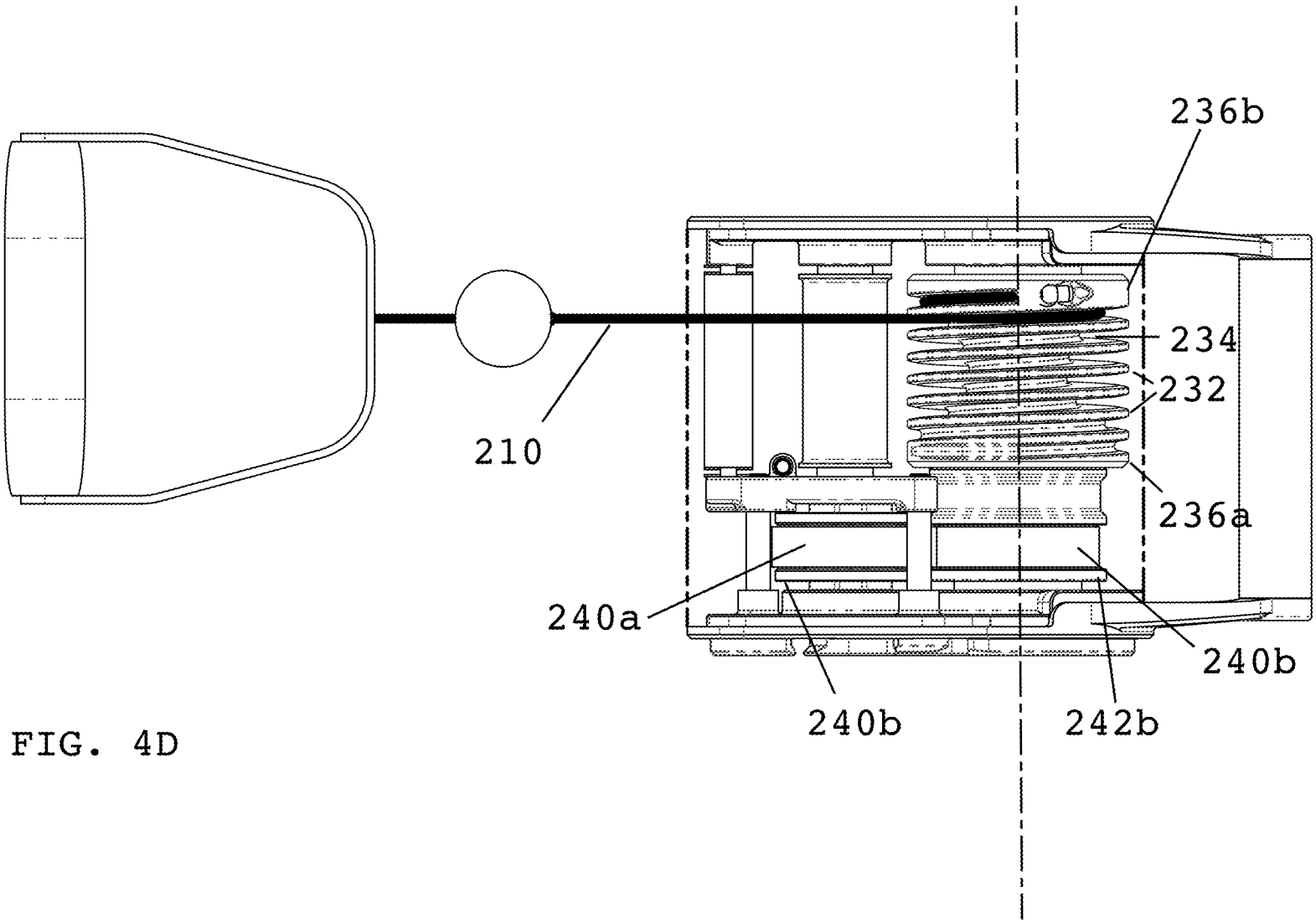
FIG. 4D shows a partial cutaway view of the stroke end of the interface mechanism.

FIG. 4D shows the interface mechanism 200 at a point towards the end of its longest pull possibility, meaning that the cable 210 has been unwound on the force modulating pulley 230 to a point where the cable receiving valleys 234 are again at their nearly maximum diameter, resulting in a lower force required to pull. Similar to the views in FIGS. 2B and 2C, this view shows that the force modulating pulley 230's counterclockwise rotation rotates the preload pulley 242*a* also in a counterclockwise direction, which winds more length of the constant force spring 240, towards a maximum, from the preload section 240*a* to the storage section 240*b*.

The return of the cable 210 from the FIG. 4D end position to its starting position in FIG. 4A happens in the opposite order from FIGS. 4D to 4C to 4B to 4A. Releasing the cable 210 altogether may result in the storage section 240*a* of the spring exerting enough force on the cable to rewind it through these positions, or a braking mechanism (not shown) may prevent or slow this. Alternatively in normal use, the user will return the cable to the position in FIG. 4A or similar position, and in so doing, travel also backwards along the force curve discussed in FIG. 1.

Figure 1:
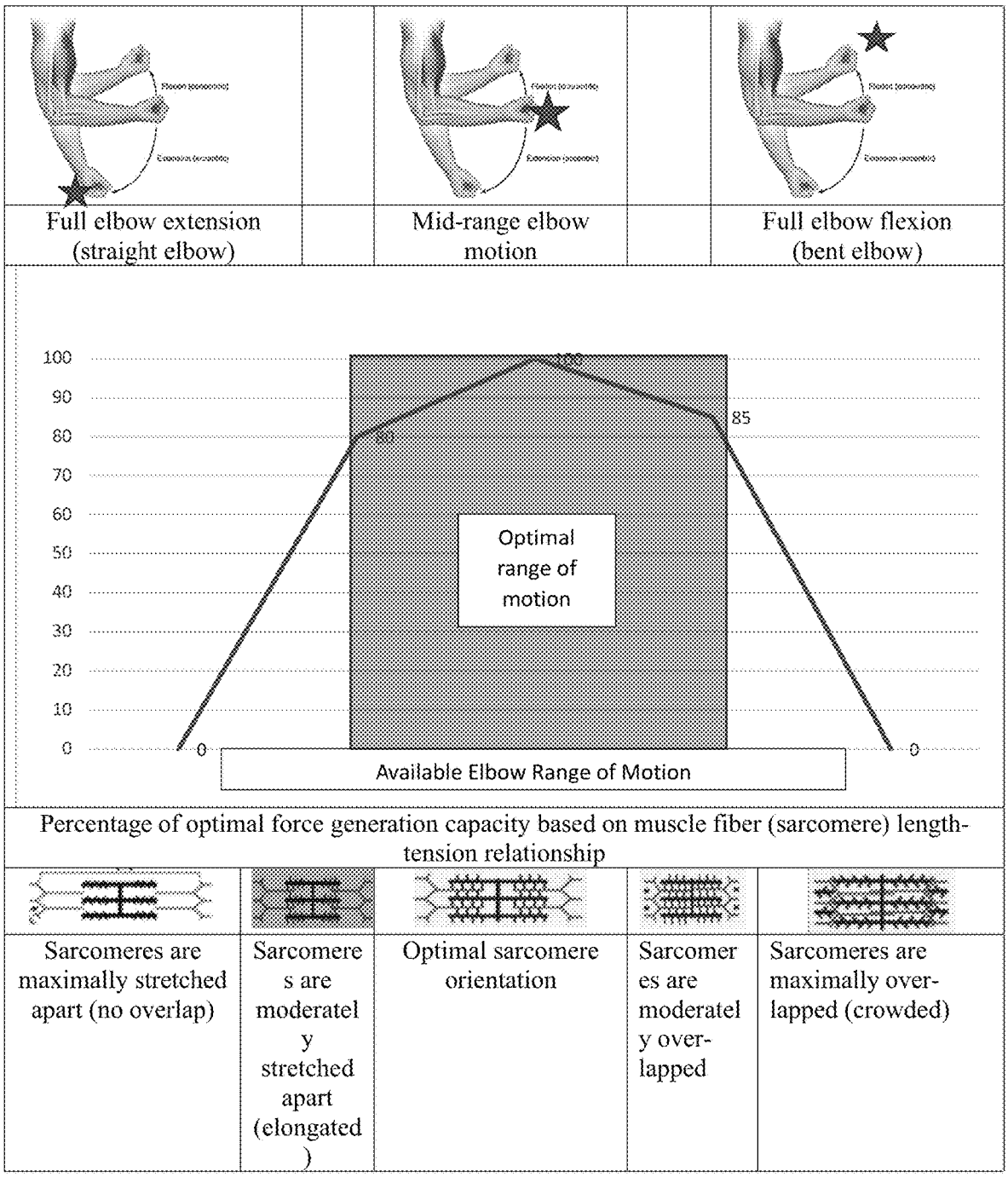
FIG. 1 (prior art)
FIG. 1 is a prior art figure showing a relationship of skeletal muscle fiber length-tension to joint position (using the elbow as an example).

As can be appreciated moving from high diameter valleys 234 at the starting end 236*a* of the force modulating pulley to low diameter valleys 234 in the middle 236*c* to higher diameter valleys 234 (to form an hourglass shape) at the finishing end 236*b* results in a force modulation when drawing the cable 210, with the force required going from low too high to low, mirroring the graph shown in FIG. 1 and thus serving to flatten the force required through the movement.

The below table shows an example of how the force might be distributed for interface mechanisms and cartridges.

TABLE 1

| | Beginning resistance | Middle Resistance | End Resistance |
|---|---|---|---|
| Interface mechanism | 5 lbs | 10 lbs | 5 lbs |
| Interface mechanism + 1 cartridge | 10 lbs | 20 lbs | 10 lbs |
| Interface mechanism + 2 cartridges | 15 lbs | 30 lbs | 15 lbs |
| Interface mechanism + 3 cartridges | 20 lbs | 40 lbs | 20 lbs |

Figure 5:
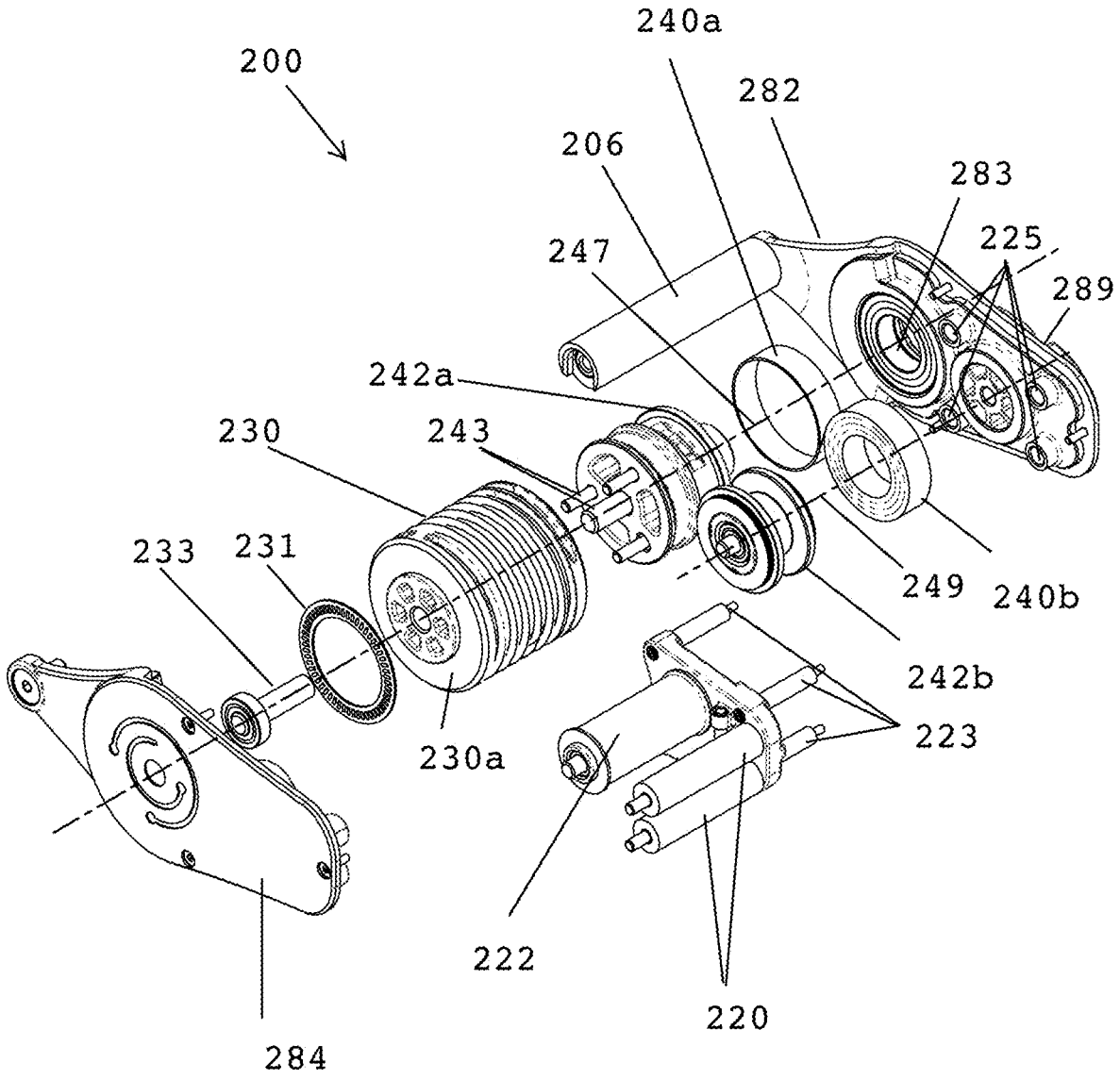
FIG. 5 shows an exploded view of the interface mechanism.
Figure 6:
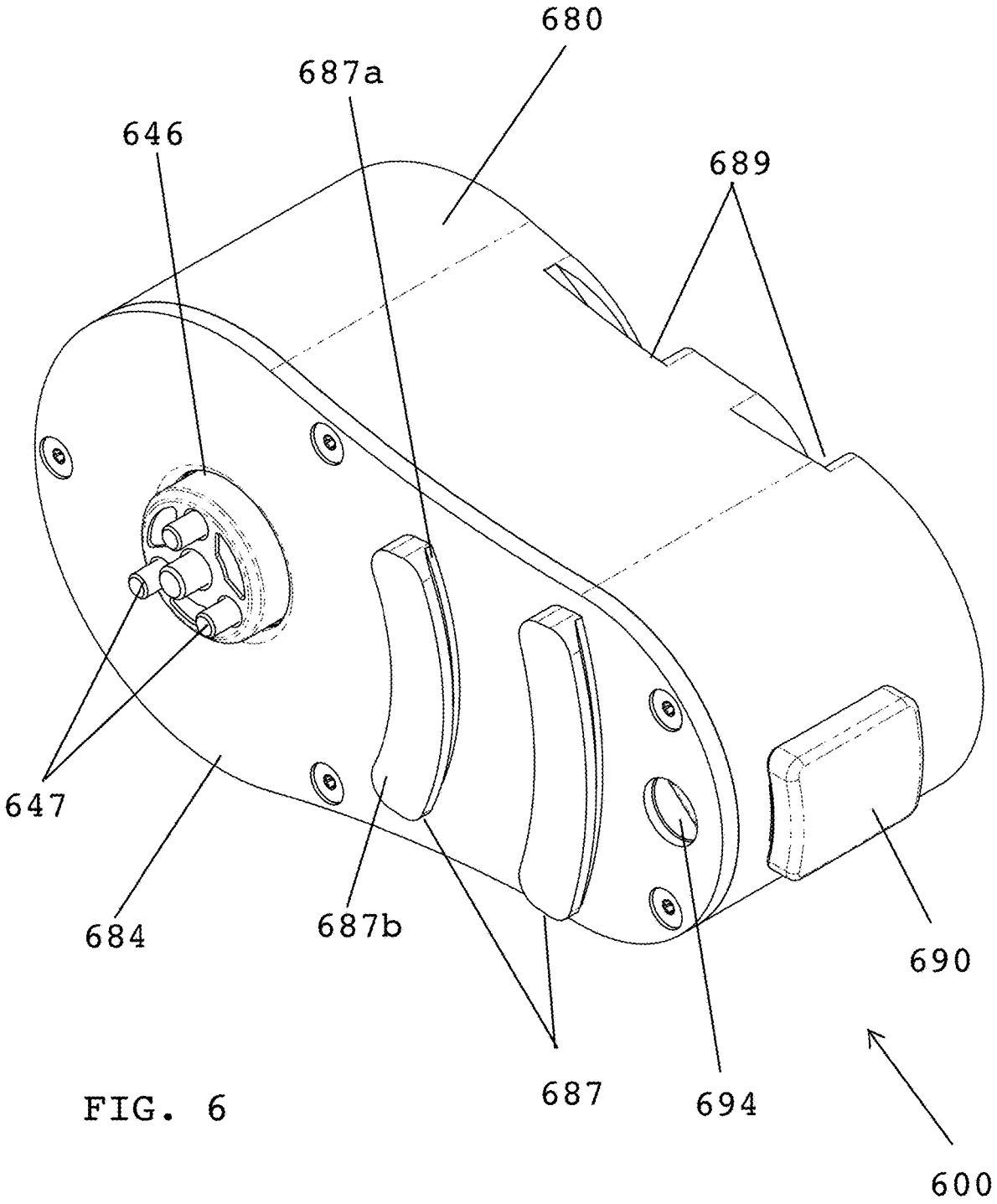
FIG. 6 shows a perspective view of the cartridge.
Figure 7:
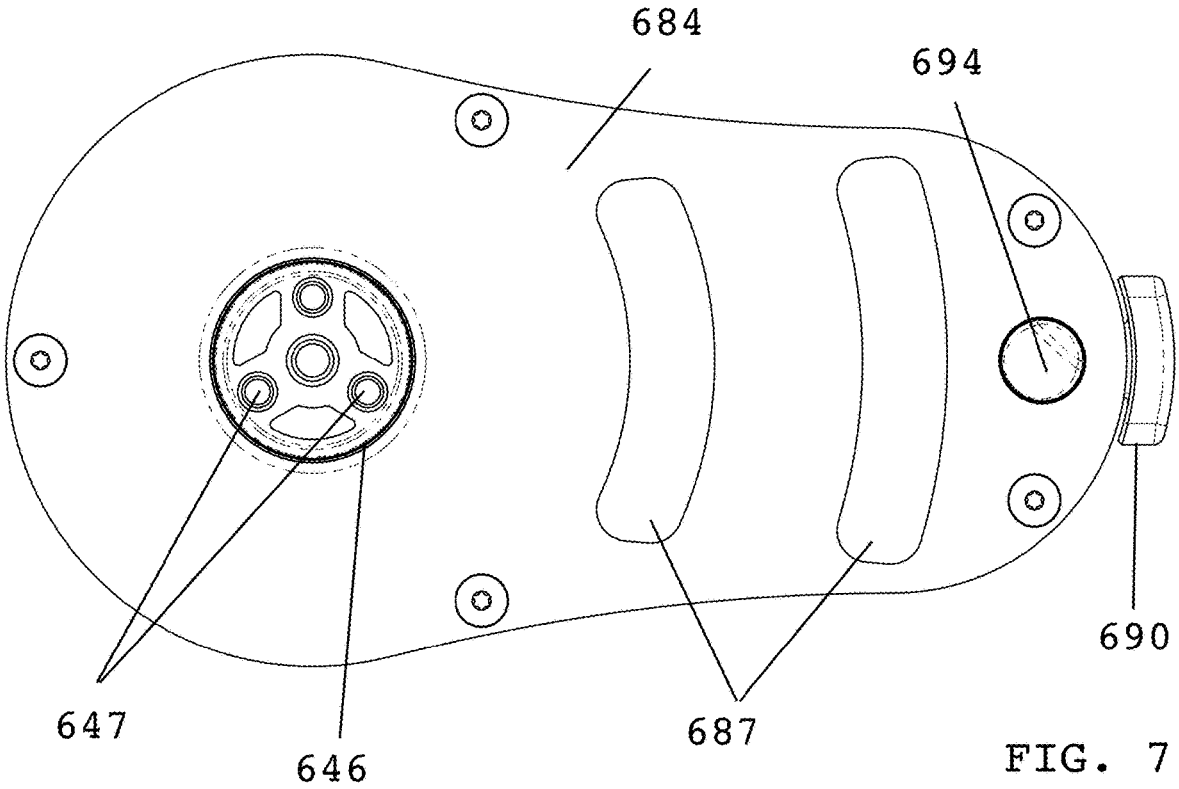
FIG. 7 shows a bottom view of the cartridge.
Figure 8:
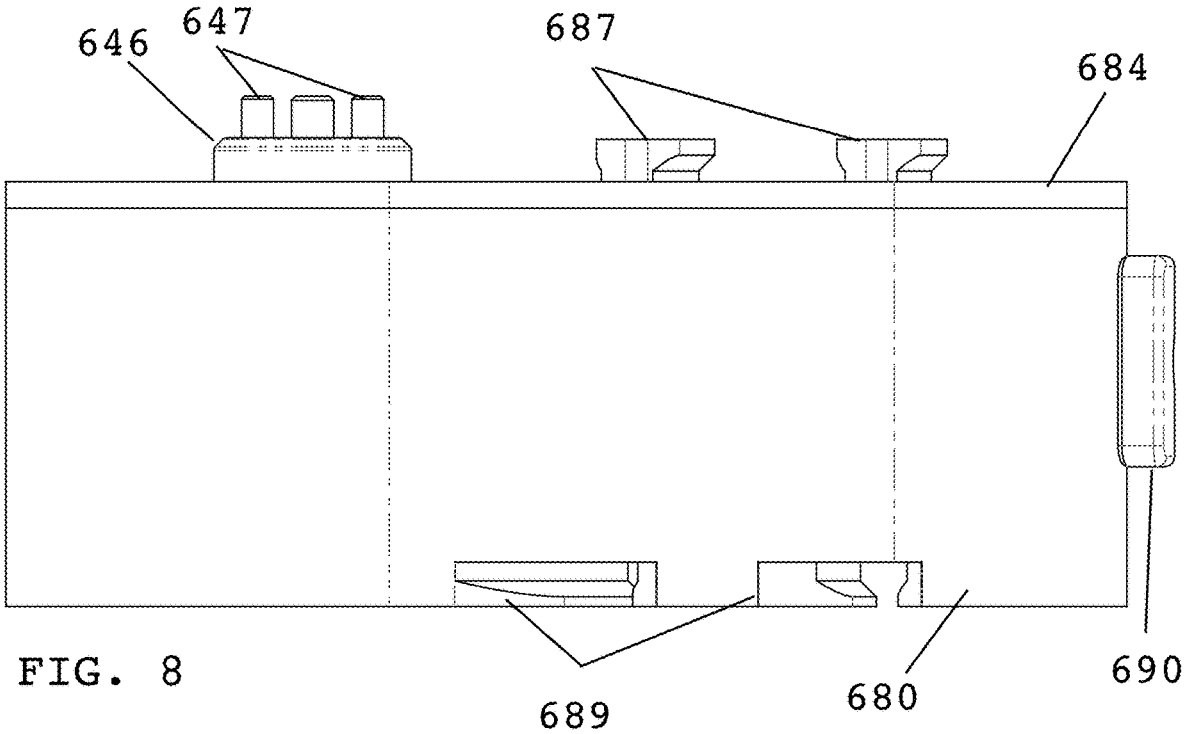
FIG. 8 shows a side elevation view of the cartridge.
Figure 9:
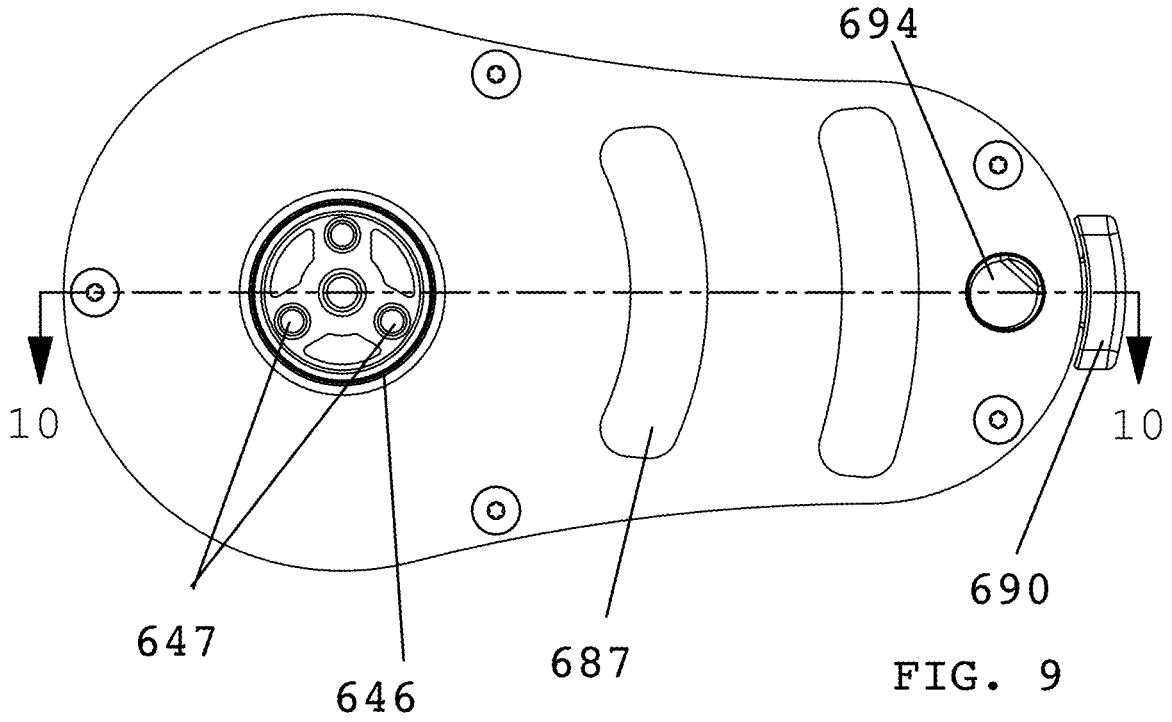
FIG. 9 shows the same view as FIG. 7, oriented to show FIG. 10, which is the section through the line 10-10.
Figure 10:
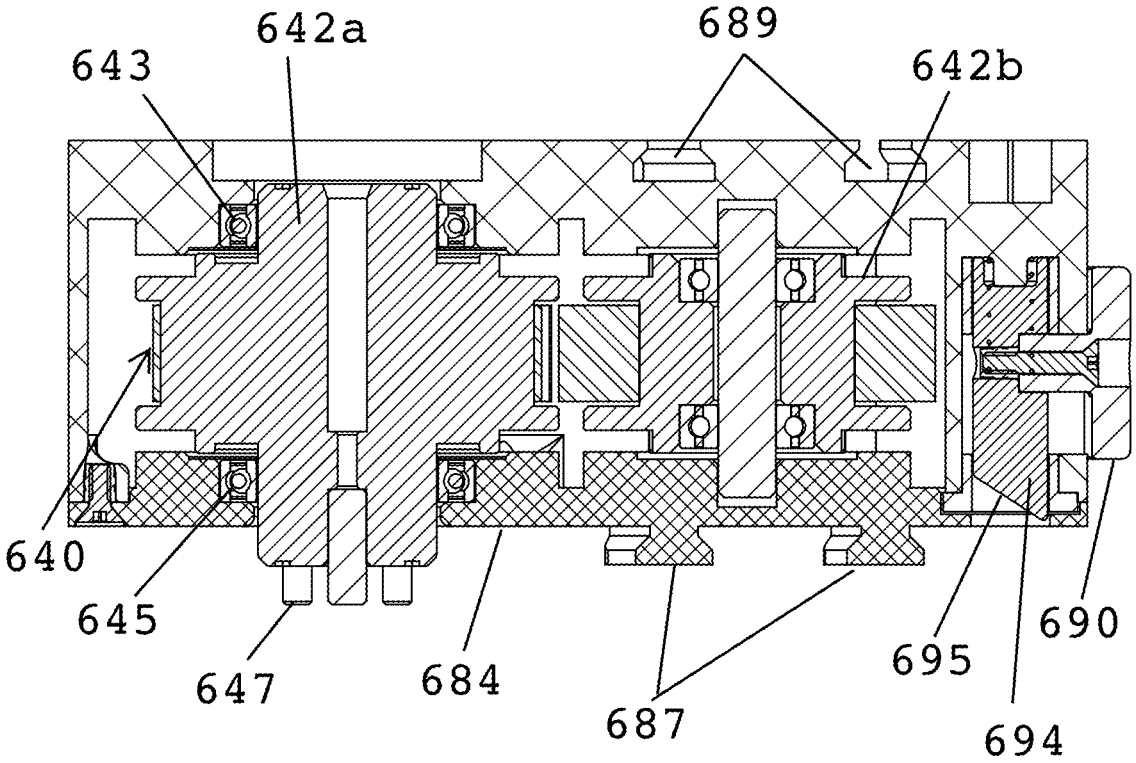
Figure 11:
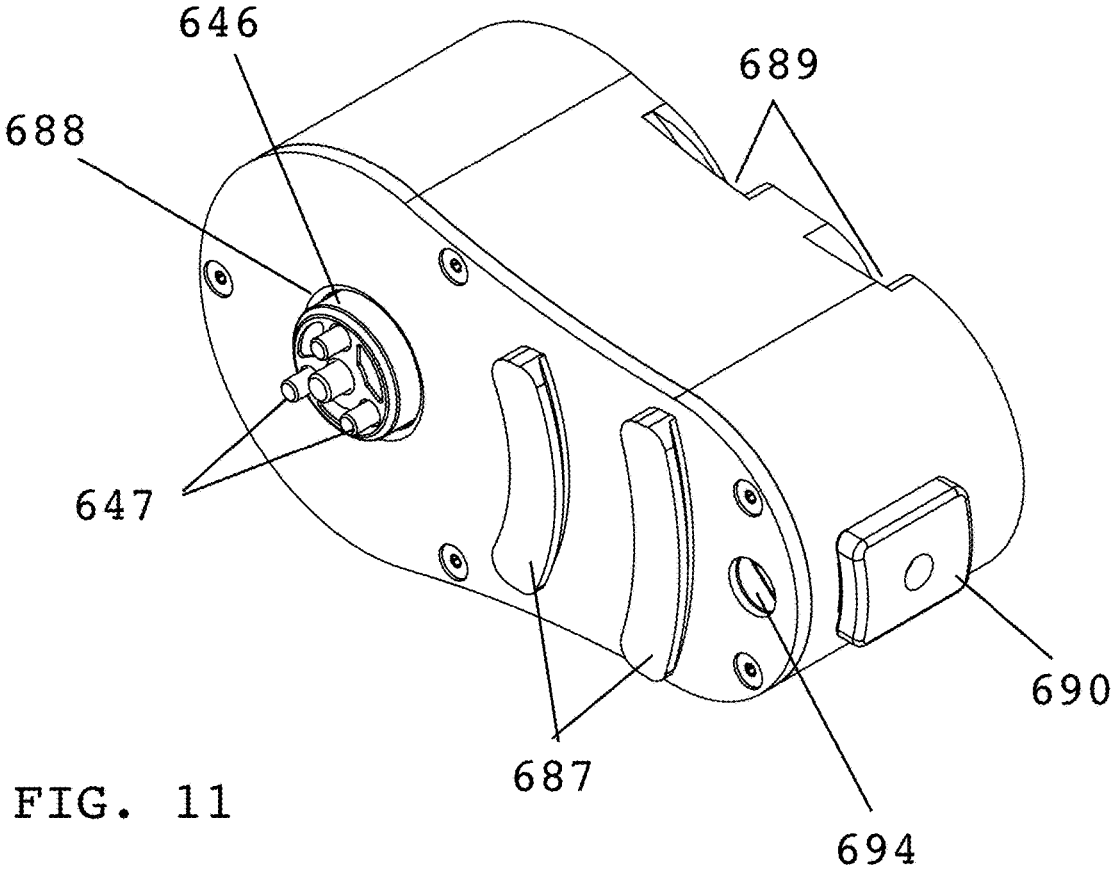
FIGS. 11 and 12 show different perspective views of the cartridge.
Figure 12:
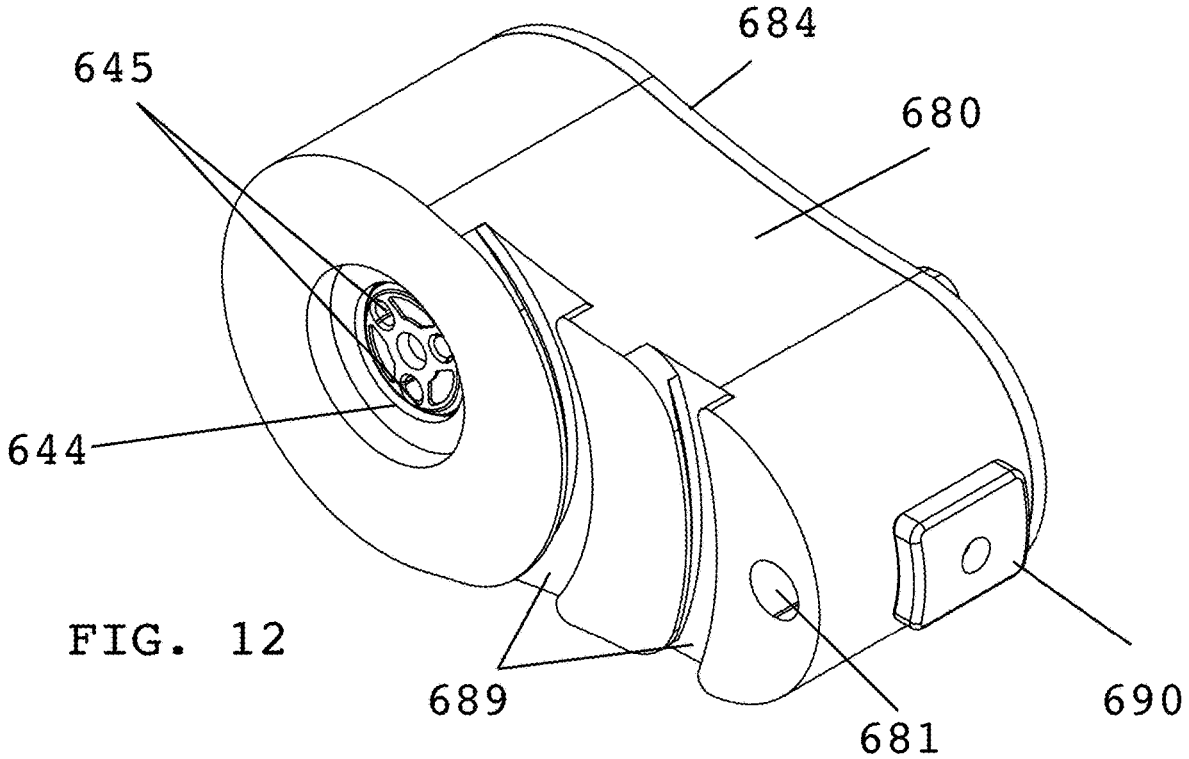
Figure 13:
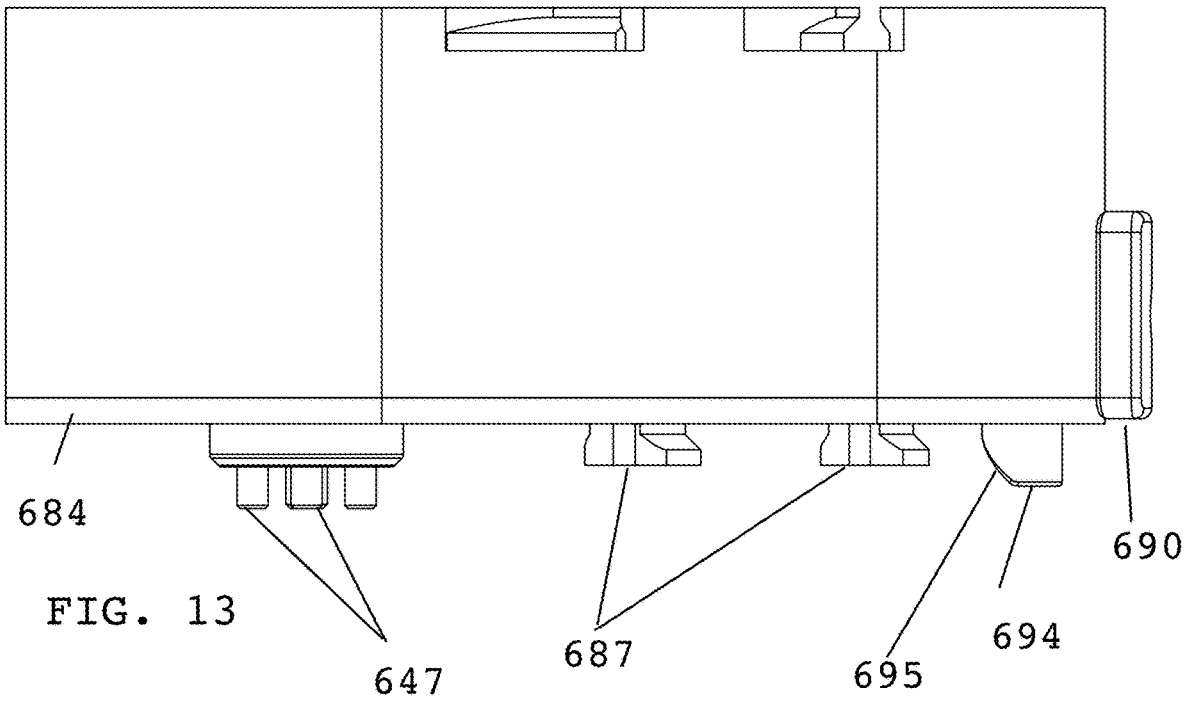
FIGS. 13 and 14 show side elevations from opposite sides of the cartridge.

FIG. 5 shows an exploded and assembled view of the interface mechanism 200. Certain parts have been omitted but it should be appreciated from the view in FIG. 5 that the constant force spring 240 is wound around both pulleys 242*a*, 242*b*. Certain axial pins and other features are not shown for simplicity and other features are shown but not discussed as they would be apparent to those of skill in the art. Not every mounting is shown but the force modulating pulley 230 is partially mounted for rotation about axial pin 233 and may include a ring bearing 231 shaped to engage a face 230*a* to encourage frictionless rotation as well.

Engagement pins 223 may help secure the alignment pulleys 220, 222 through the engagement pins 223 to receiving cylinders 225 in the end plate 282.

FIGS. 6-15 show different views of a force cartridge 600 that can be attached to the interface mechanism 243 to increase the force required to draw the cable 210 there from. In use and without certain disassembly or other adjustments such as tightening the constant force spring 240, the interface mechanism 200 cannot be adjusted, or only adjusted to some limited extent.

Figure 15:
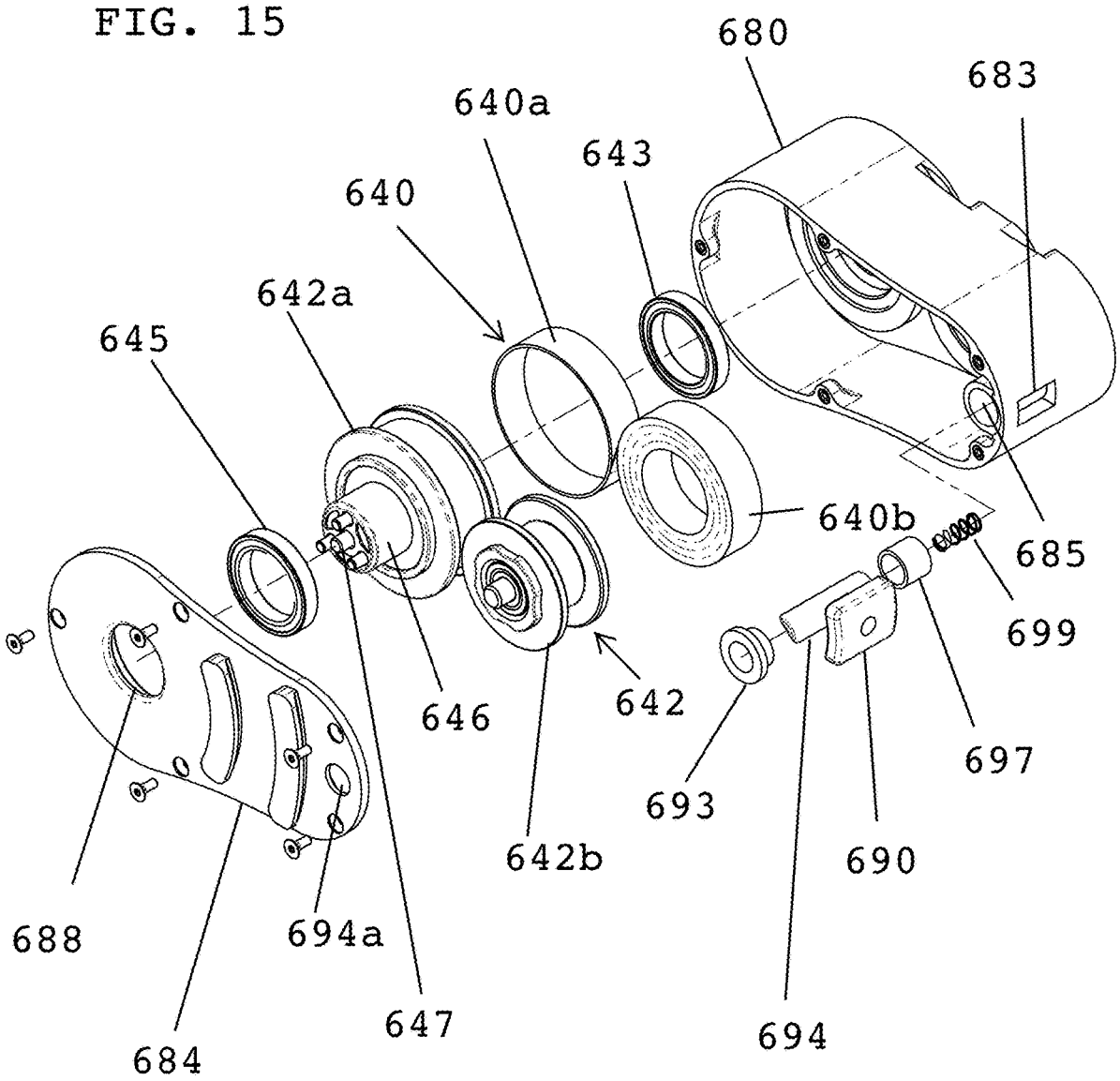
FIG. 15 shows an exploded view of the cartridge.

The force cartridge 600 comprises several parts, several of which are shown in the exploded view in FIG. 15, including the main housing 680, cartridge preload pulley 642*a*, cartridge storage pulley 642*b*, cartridge constant force spring 640 with a cartridge spring preload section 640*a* and cartridge spring storage section 640*b*, and cartridge end plate 684.

Similar to the arrangement in the interface mechanism 200, the cartridge constant force spring is engaged to the cartridge pulleys 642*a*, 642*b* such that as one of the cartridge pulleys rotates, the other cartridge pulley rotates in an opposite direction as lengths of the constant force springs moves between the cartridge spring preload section 640*a* and cartridge spring storage section 640*b* and back.

Figure 20:
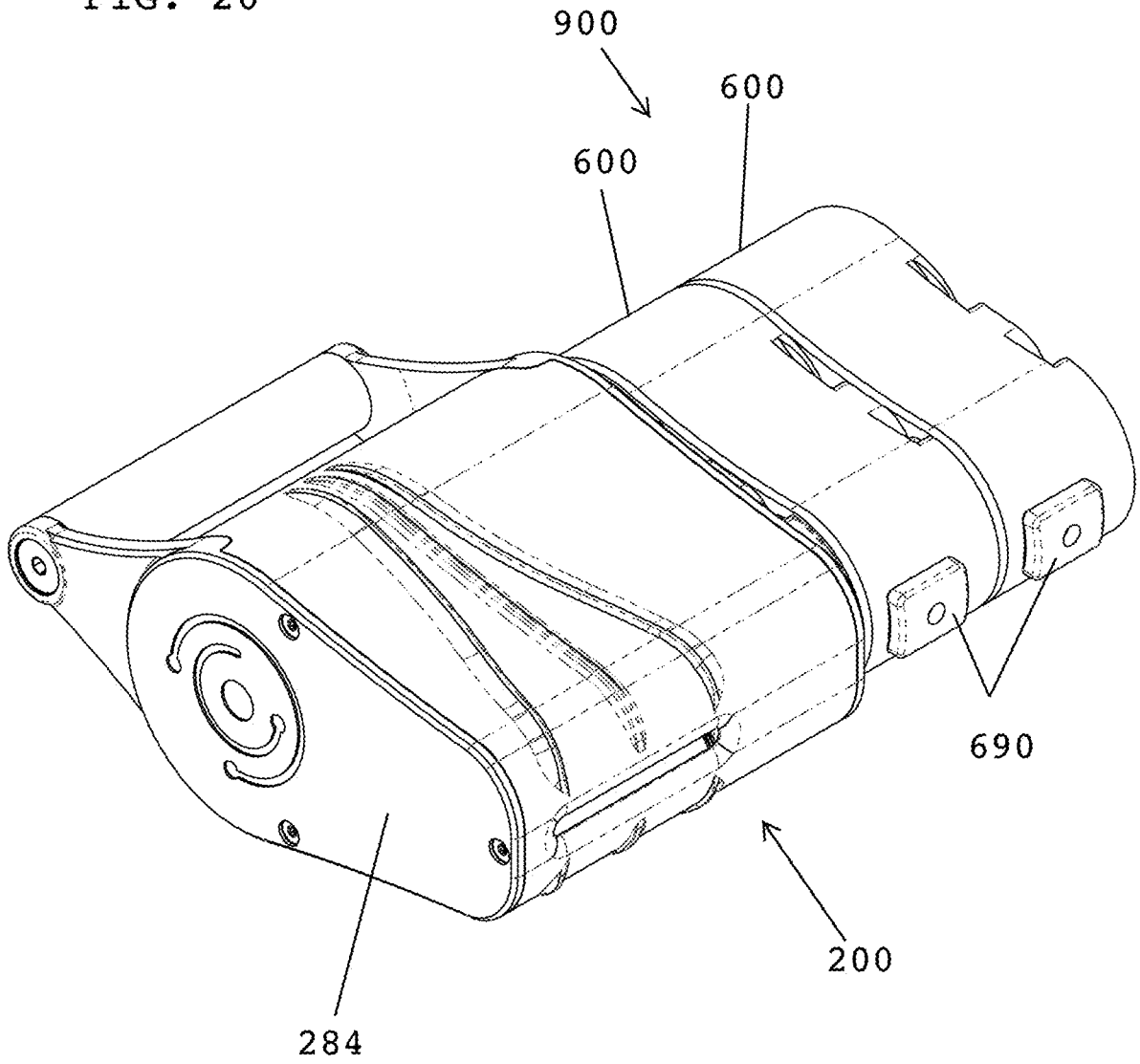
FIGS. 20 and 21 show two cartridges engaged to an interface mechanism.
Figure 21:
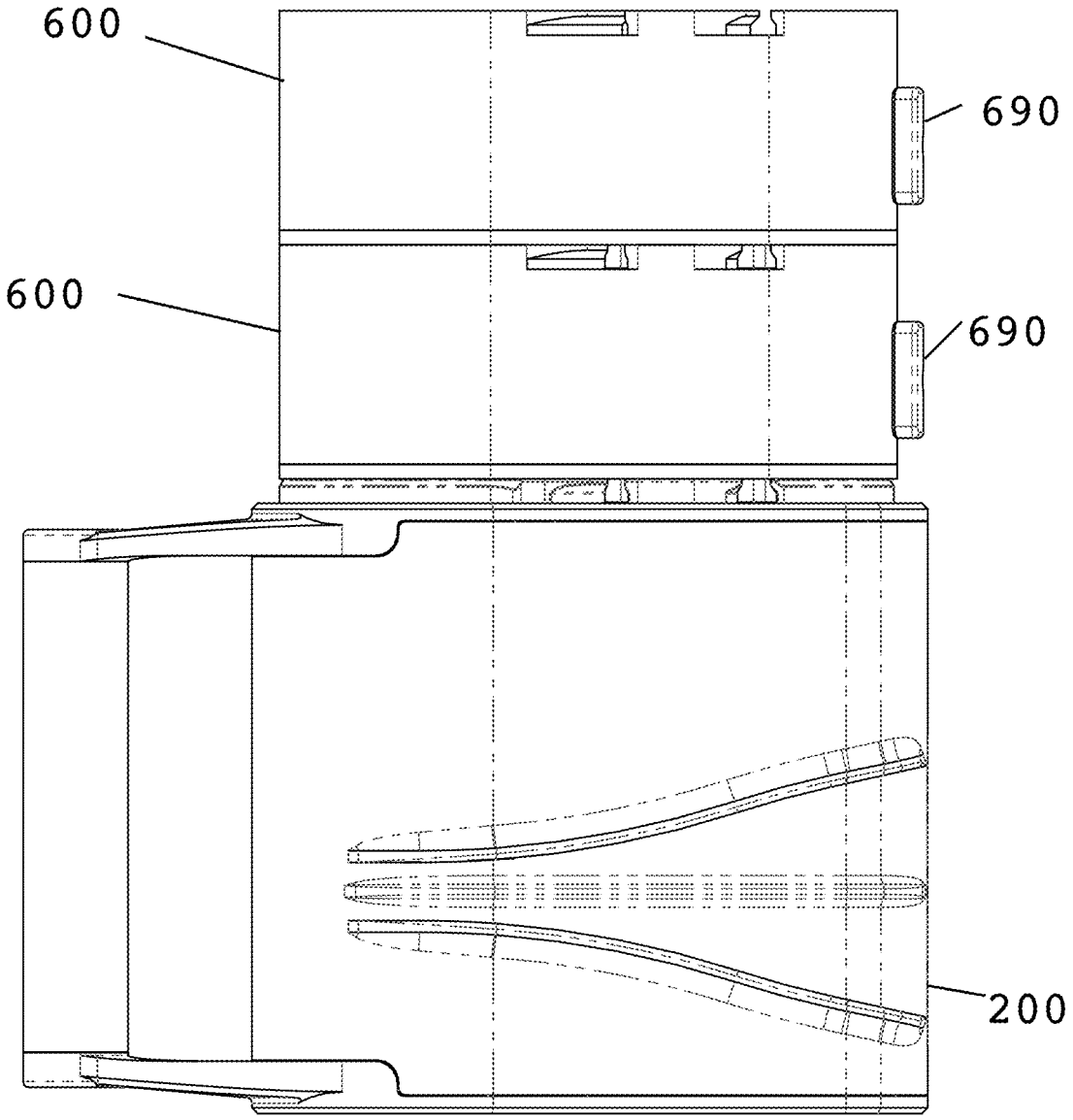

The cartridge storage pulley 642*a* includes a cartridge lock 644 with holes 645 (see FIG. 12) configured to engage a cartridge key 646 with locking pins 647. The cartridge lock aligns with a cartridge end plate opening 686, which opens to the cartridge lock 644. The cartridge key 646 extends through a roller bearing 645 and into a housing hole 688. The roller bearing 645 is shaped to engage the cartridge key 646 and reduce friction as it moves. A similar roller bearing 643 engages the other end of the cartridge storage pulley 642*a*. Each cartridge key 646 can engage cartridge locks 644 such that movement preload pulleys 642*a* in stacked cartridges 900 (FIG. 20) moves all pulleys 642.

Figure 16:
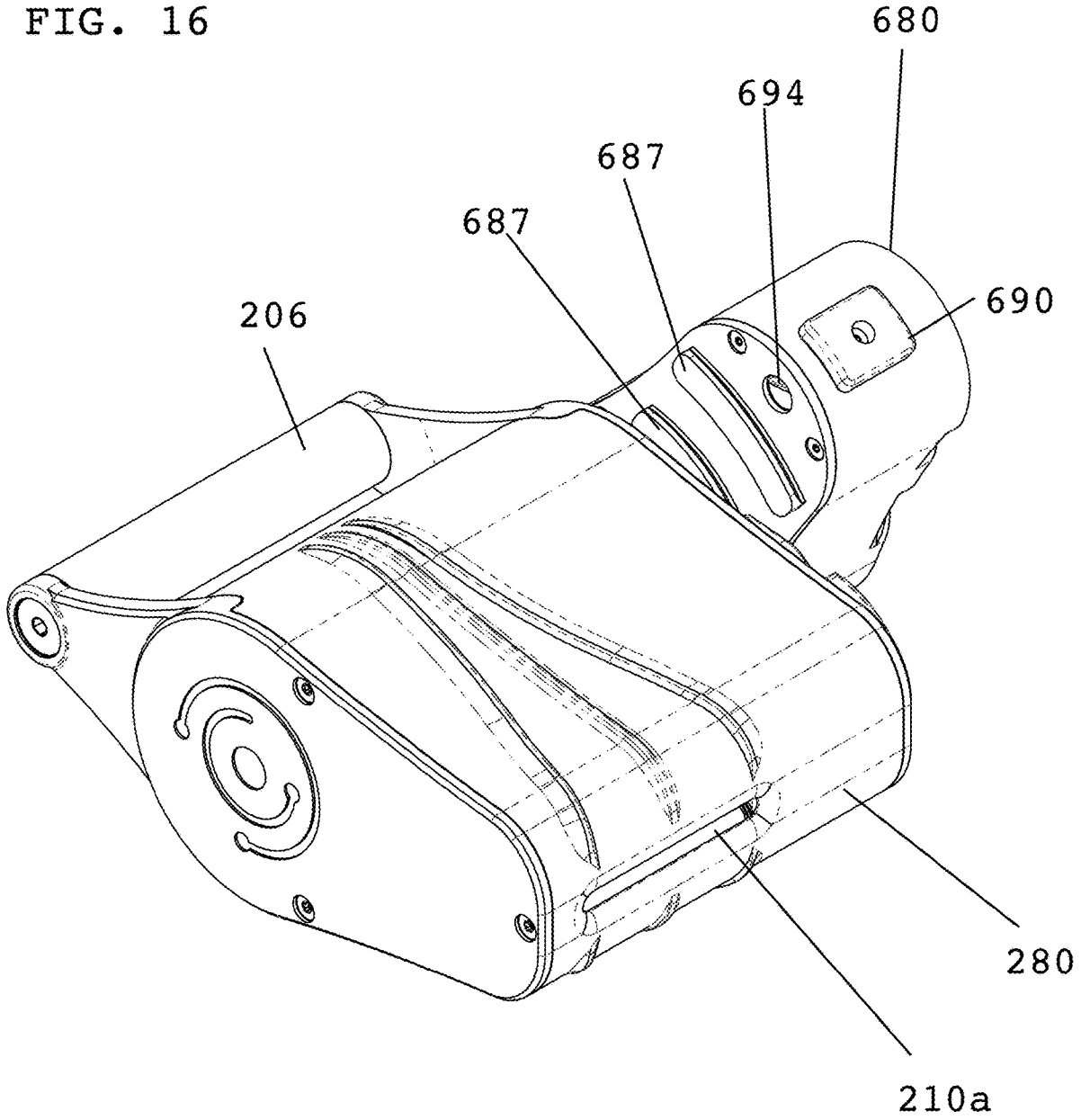
FIGS. 16, 17A, and 18 show sequential steps of engagement between a cartridge and an interface mechanism.
Figure 17A:
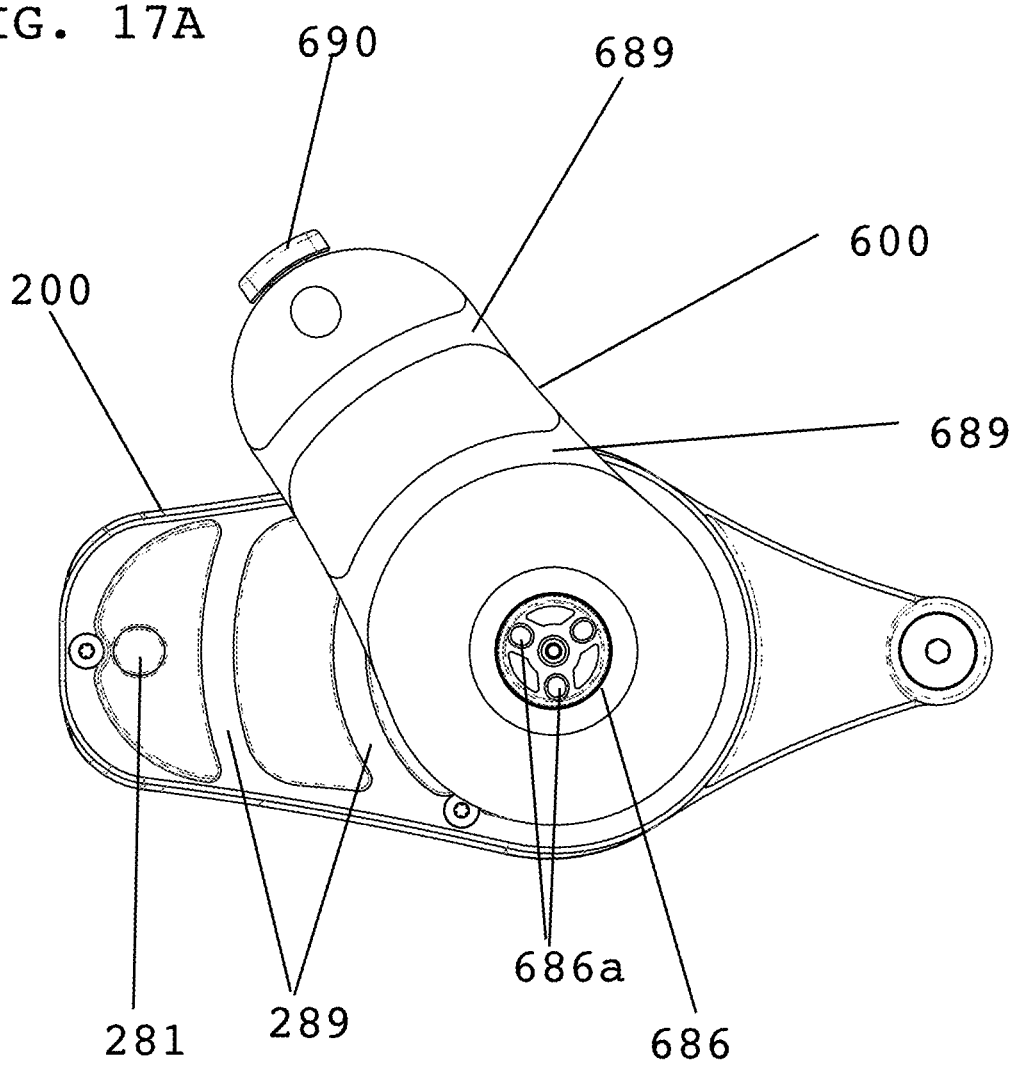
Figure 17B:
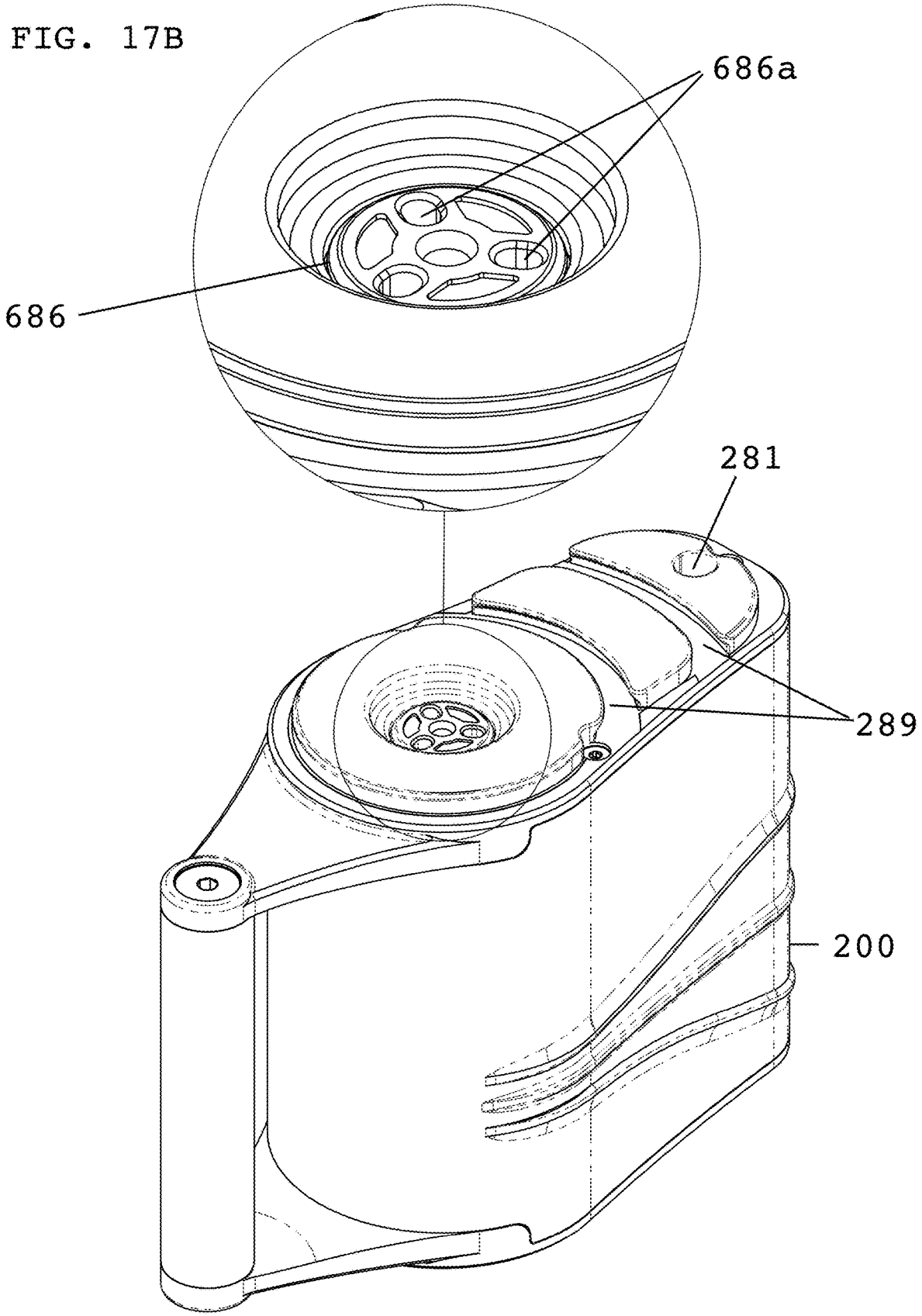
FIG. 17B shows a perspective view of the interface mechanism with an enlargement that shows how the interface mechanism engages to the cartridge.

A cartridge 600 can engage the interface mechanism 200 as shown in the sequential steps in FIGS. 16-18) to increase the constant force required to draw the cable 210 as follows. The preload pulley 242*a* includes a preload pulley lock 243 that extends through a hole 283 in the end plate 282. As shown in FIG. 16, a user inserts cartridge key 646 with its extending pins 647 through hole 283 and into the preload pulley lock 234. As shown in FIG. 17A (with more details in FIG. 17B that shows the interface mechanism 200 without a cartridge 600), the user then rotates the cartridge 600 and this engages the cartridge extending guides 687 with interface mechanism slots 289 to further secure the cartridge 600 and interface mechanism 200 together. It should be appreciated that the guides 687 and slots 289, 689 are shaped to prevent pulling the parts apart through the guides having an approximately T-shaped cross section with narrower portions 687*a* and wider portions 687*b* that corresponding engage narrower and wider portions in the slots 287, 687. Moving through the engagement figures from FIGS. 17 to 19, the cartridge locking pin 694, which is biased by spring 699 (inside spring collar 697) to extend through the collar 693 and cartridge end plate hole 694, has a slanted face 695 that upon encountering a surface such as the interface locking mechanism end plate 284 or cartridge housing 680 drives the cartridge locking pin 694 into the cartridge 600 into opening 694*a*.

Figure 14:
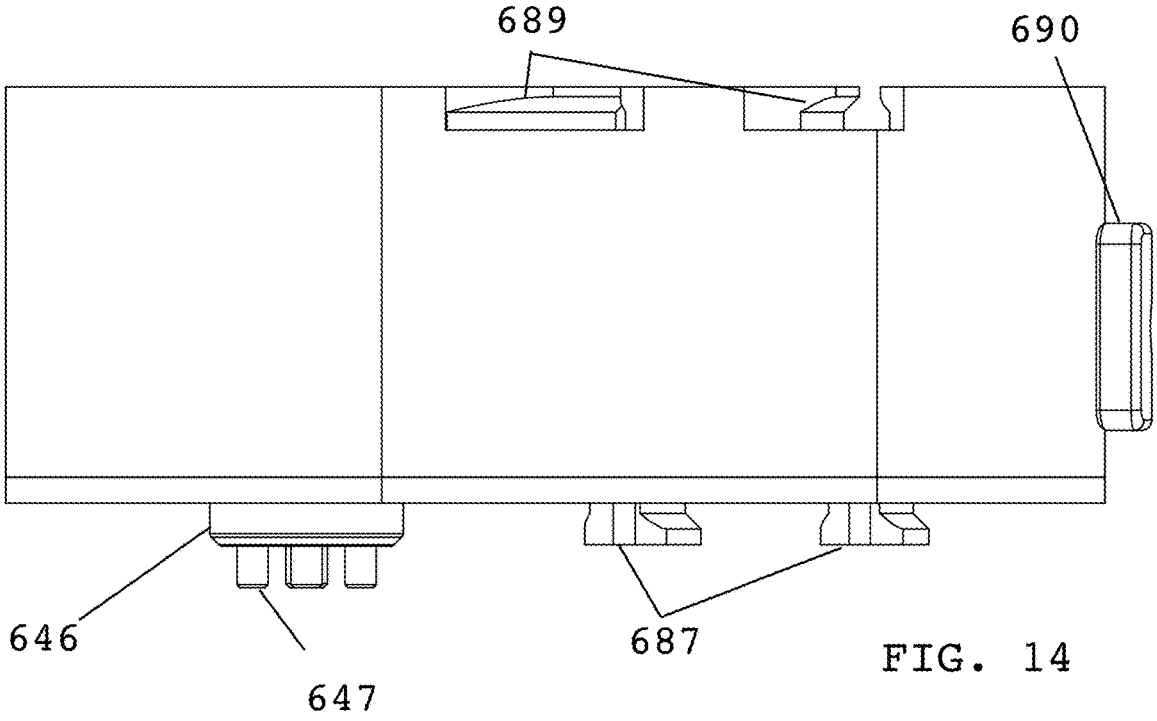
Figure 18:
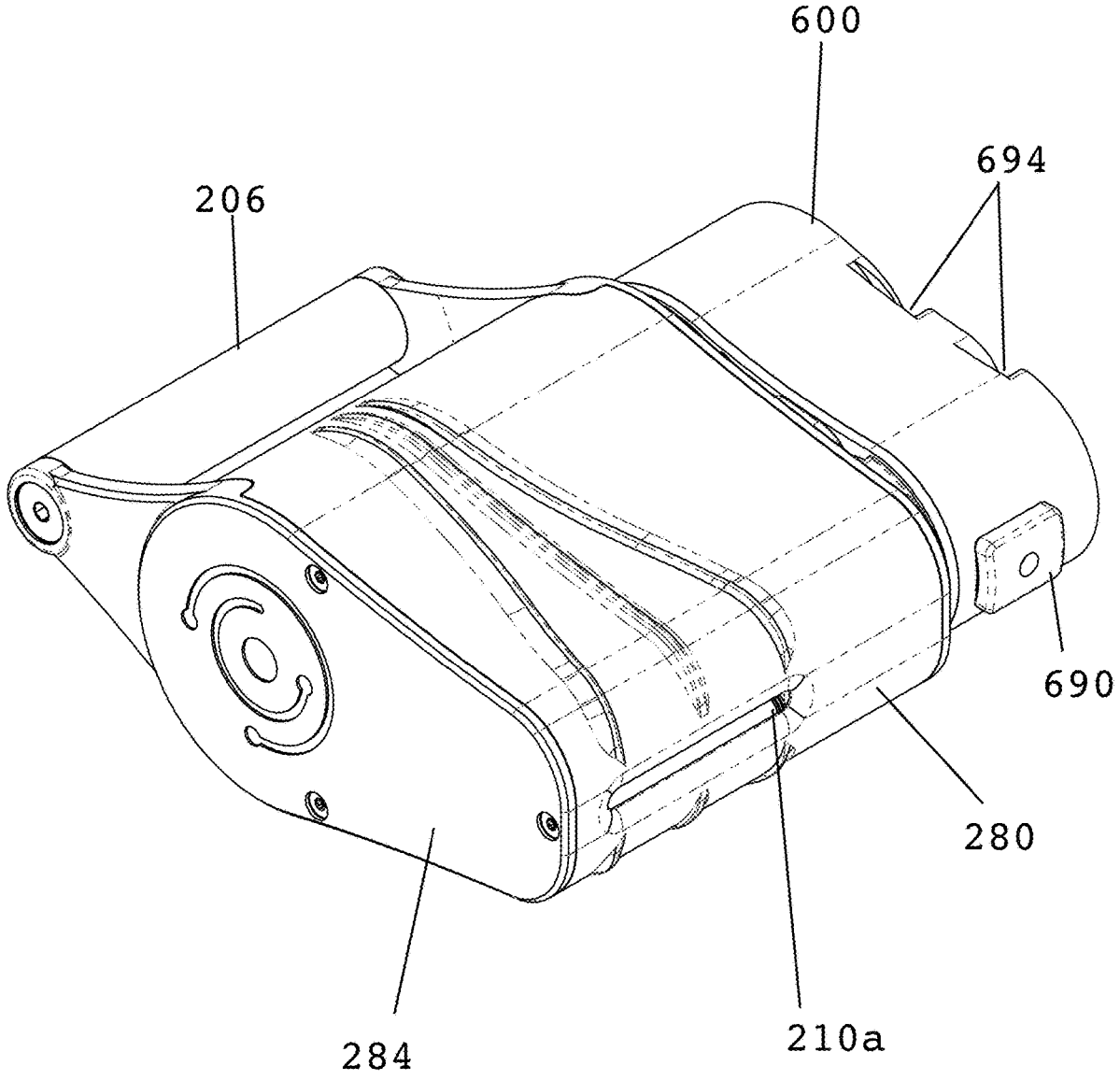
Figure 19:
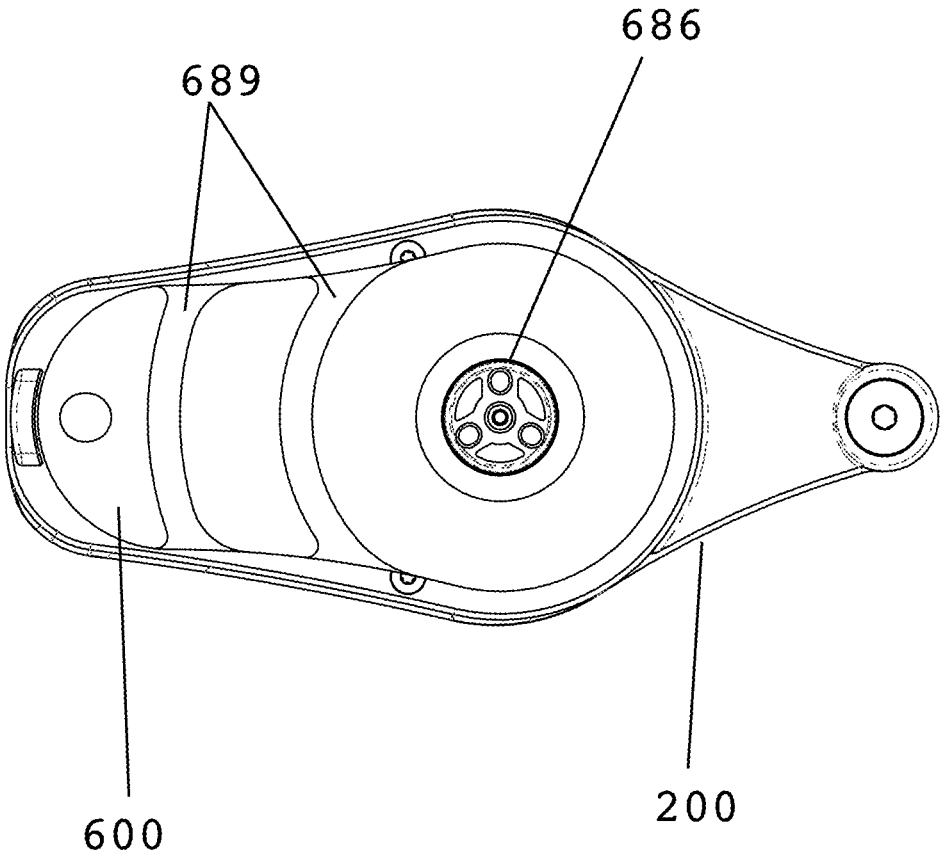
FIG. 19 shows a side view of a cartridge engaged to an interface mechanism.

Before reaching the final position in FIG. 18 (and a similar position for stacked cartridges in FIGS. 20 and 21), the cartridge locking pin 694 is thus retracted into the cartridge 600 with the pin 694 biased by spring 699 against a surface of the end plate 294 (or cartridge housing 680) until further movement towards the final position in FIG. 18 allows the spring 699 to drive the cartridge locking pin into locking pin receiving holes 281, 681 in the interface mechanism 200 and cartridge 600 respectively. Once locked in place in this non-slip engagement as shown in FIGS. 18, 19, 20, and 21 removal of a cartridge 600 requires movement in the opposite direction back through these figures, or as understood back through a series of steps for stacked cartridges, but the first step involves drawing the cartridge locking pin 694 back into the cartridge against the force of the biasing spring 699. This is done by moving the release button 690 from its locked position (FIG. 13) to its released position (FIG. 14).

Once engaged, the preload pulley 242*a* and cartridge preload pulley 642*a* rotate in sync and thus transmit a constant—but cartridge-enhanced increased—force through the interface mechanism 200 against the cable 210. In this way, the addition of a cartridge 600 increases the force required to draw the cable 210 from the interface mechanism 200. Stacked cartridges 900 engage cartridge locks 644 with holes 645 to cartridge keys 646 with locking pins 647 further increase the force required. The force transferred in stacked cartridges 600 works similarly to the way that cartridges 600 add resistance to the interface mechanism 200. A successive cartridge 600's cartridge key 646 and locking pins 647 extend into the lock 644 and holes 645 that are engaged to the preload pulley 642*a*, setting up an increased resistive force from a successive cartridge 600 to a first cartridge 600 and into the interface mechanism as previously described.

Successive cartridges have the cartridge locking pin 694 locking ability described already, where the cartridge locking pin in successive cartridges extends into a cartridge receiving hole 681.

In use, a person would anchor the interface mechanism 200 to a stable anchor using the clamp 500 or other means to attach the mounting handle 206 to an anchor point. They would then attach an appropriate handle 202 or other grip and also the appropriate number and resistance (cartridges 600 can be of different resistance depending on the force of the springs therein) cartridges. Once set up, they would position themselves for the exercise and draw the handle 202, and thereby the cable 210 from the interface mechanism 200, embarking on the steps shown in FIGS. 4A-4D. Through this motion, the constant force spring(s) provide a baseline resistance while the force modulating pulley provides easy then harder then easier resistance as the cable 210 is drawn from the interface mechanism, and a reverse of those forces as it is returned, thus challenging the person's muscle most in the middle of their exercise stroke than at the two ends of the range of motion.

While the invention has been described with reference to the embodiments above, a person of ordinary skill in the art would understand that various changes or modifications may be made thereto without departing from the scope of the claims.

The invention claimed is:

1. An exercise device comprising:

a cable;

a force modulating pulley around which the cable is wound; and a constant force spring engaged to the force modulating pulley, wherein the constant force spring provides a constant resistance against rotation of the force modulating pulley when a force is applied to the cable;

wherein the force modulating pulley varies the force that must be applied to rotate the force modulating pulley when the force is applied to the cable;

wherein the force modulating pulley includes raised threads separated by valleys;

wherein the cable is engaged to the force modulating pulley within the valleys;

wherein the valleys have a varying diameter forming an hourglass profile extending between ends of the force modulating pulley along an axis of the force modulating pulley, wherein a minimum diameter of the hourglass profile is at a mid-point between the ends of the force modulating pulley along the axis; and wherein the threads have a constant diameter along the axis.

2. The exercise device of claim 1, wherein the constant force spring is wound around a preload pulley that rotates about a first axis.

3. The exercise device of claim 2, wherein the constant force spring is wound around a storage pulley that rotates about a second axis.

4. The exercise device of claim 3, wherein the constant force spring is a flat wound spring with a preload section engaged to the preload pulley and a storage section engaged to the storage pulley.

5. The exercise device of claim 4, wherein as the force modulating pulley rotates, more or less length of the constant force spring passes from the preload section to or from the storage section, depending on a direction of rotation of the force modulating pulley.

6. The exercise device of claim 2, further comprising cartridges that increase the constant resistance against rotation of the force modulating pulley when the force is applied to the cable.

7. The exercise device of claim 6, wherein the cartridges each comprise a cartridge constant force spring engaged to a cartridge preload pulley that is engaged to the preload pulley to increase the constant resistance.

8. The exercise device of claim 7, wherein the engagement between the cartridge preload pulley and the preload pulley is a non-slip engagement.

9. The exercise device of claim 6, wherein the cartridges each comprise a constant force spring engaged to one another in an engagement that further increases the constant resistance.

10. The exercise device of claim 1, further comprising a protective housing through which a portion of the cable extends.

11. The exercise device of claim 10, further comprising a cable stop that prevents the cable from being drawn into the device beyond a location of the cable stop.

12. The exercise device of claim 10, further comprising a handle configured to be attached to an anchor.

13. The exercise device of claim 12, wherein the handle is configured as a clamp.

14. The exercise device of claim 1, further comprising a housing that contains the force modulating pulley and the constant force spring; wherein a first portion of the cable is inside the housing and a second portion of the cable pulley is outside the housing, and the housing comprises a slot through which the cable extends from inside the housing to outside the housing.

* * * * *